US007857490B1

(12) United States Patent
Fett et al.

(10) Patent No.: US 7,857,490 B1
(45) Date of Patent: Dec. 28, 2010

(54) COLLAPSIBLE LIGHTING DEVICE

(75) Inventors: David J. Fett, Bluffton, OH (US); Robert J. Hayes, Lewis Center, OH (US); Matt Bowers, Powell, OH (US); Don Staufenberg, Dublin, OH (US); Jamison J. Float, Westerville, OH (US); James Lua, Columbus, OH (US)

(73) Assignee: Frontier Lighting Technologies, LLC, Bluffton, OH (US)

( * ) Notice: Subject to any disclaimer, the term of this patent is extended or adjusted under 35 U.S.C. 154(b) by 0 days.

(21) Appl. No.: 12/386,260

(22) Filed: Apr. 15, 2009

Related U.S. Application Data

(60) Provisional application No. 61/207,559, filed on Feb. 13, 2009.

(51) Int. Cl.
*F21V 33/00* (2006.01)

(52) U.S. Cl. ..... 362/352; 362/351

(58) Field of Classification Search ..... 362/352, 362/351, 355, 154, 155, 156, 363, 362, 431, 362/396, 399
See application file for complete search history.

(56) References Cited

U.S. PATENT DOCUMENTS

| | | | | |
|---|---|---|---|---|
| 1,530,923 | A | 3/1925 | Anns | |
| 2,383,390 | A | 8/1945 | Jacobs | |
| 2,871,343 | A | 1/1959 | Whitney | |
| 2,936,366 | A | 5/1960 | Rainford | |
| 3,592,157 | A | 7/1971 | Schwartz | |
| 4,120,025 | A * | 10/1978 | Deaven | 362/153 |
| 4,542,445 | A | 9/1985 | Marletta | |
| 4,562,521 | A | 12/1985 | Noguchi | |
| 4,586,456 | A | 5/1986 | Forward | |
| 4,787,575 | A | 11/1988 | Stewart | |
| 4,794,498 | A | 12/1988 | Neumeier | |
| 4,997,403 | A | 3/1991 | Akman | |
| 5,034,847 | A | 7/1991 | Brain | |
| 5,075,830 | A | 12/1991 | Perez | |
| 5,083,250 | A | 1/1992 | Malcolm | |
| 5,102,364 | A | 4/1992 | Kubiatowicz | |
| 5,295,891 | A | 3/1994 | Schalk | |
| 5,653,531 | A | 8/1997 | Yang | |
| 5,782,668 | A | 7/1998 | Chabert | |
| 5,857,760 | A | 1/1999 | Pelton | |
| 5,893,636 | A | 4/1999 | Babineaux | |
| 5,947,581 | A | 9/1999 | Schrimmer et al. | |
| 6,012,826 | A | 1/2000 | Chabert | |
| 6,106,135 | A | 8/2000 | Zingale et al. | |
| 6,142,415 | A | 11/2000 | Ambrico | |
| 6,186,640 | B1 * | 2/2001 | Typaldos | 362/156 |

(Continued)

FOREIGN PATENT DOCUMENTS

| | | |
|---|---|---|
| WO | PCT/US92/00455 | 8/1992 |

*Primary Examiner*—Laura Tso
(74) *Attorney, Agent, or Firm*—Roger A. Gilcrest

(57) ABSTRACT

The present invention includes a collapsible lighting device comprising: (a) a container having a base portion and optional lid portion, that is adapted to be reversibly moved from a closed position to an open position; (b) at least one light source disposed in the container; and (c) a collapsible envelope of a diffuser material disposed in the container, and adapted to be reversibly moved from a contained position defining a contained volume within the container when the container is in the closed position, to a deployed position when the container is in the open position.

22 Claims, 23 Drawing Sheets

U.S. PATENT DOCUMENTS

| | | | | |
|---|---|---|---|---|
| 6,227,677 | B1 | 5/2001 | Willis | |
| 6,305,827 | B1 | 10/2001 | Nolle | |
| 6,527,418 | B1 | 3/2003 | Scherba | |
| 6,612,711 | B1 | 9/2003 | Hagenbach et al. | |
| D481,486 | S | 10/2003 | Lam | |
| D488,575 | S | 4/2004 | Aguilera | |
| 6,851,826 | B2 | 2/2005 | James | |
| 6,966,676 | B2 | 11/2005 | Chabert et al. | |
| 6,981,785 | B1 | 1/2006 | Watchulonis | |
| 7,234,853 | B2 | 6/2007 | Givoletti | |
| 7,246,913 | B2 | 7/2007 | Ossolinski | |
| 7,252,414 | B2 | 8/2007 | Chabert | |
| 7,264,382 | B2 | 9/2007 | Yoshimori et al. | |
| D565,239 | S | 3/2008 | Meeker et al. | |
| 7,367,698 | B2 | 5/2008 | Miller | |
| 7,380,966 | B2 | 6/2008 | Fong | |
| 7,400,439 | B2 | 7/2008 | Holman | |
| 7,513,638 | B2 * | 4/2009 | Allsop et al. | 362/183 |
| 2007/0236922 | A1 * | 10/2007 | Sheehan et al. | 362/162 |
| 2008/0180958 | A1 * | 7/2008 | Tsai | 362/352 |

* cited by examiner

COLLAPSIBLE LIGHTING DEVICE

RELATED APPLICATION DATA

This application claims the priority benefit of U.S. Provisional Application Ser. No. 61/207,559, filed Feb. 13, 2009, which is hereby incorporated in its entirety herein by reference.

TECHNICAL FIELD

The present invention relates to the field of portable lighting devices.

BACKGROUND OF THE INVENTION

In the field of task lighting, such as for interior construction, painting and similar do-it-yourself applications, it is desirable to provide uniform, diffuse and non-glare lighting for this type of work spaces.

SUMMARY OF THE INVENTION

The present invention includes a portable lighting device featuring a collapsible diffuser that provides the integration of features that protect the diffuser, bulbs, etc. for storage and transportation.

The present invention includes a collapsible lighting device comprising: (a) a container having a base portion and a lid portion, the portions adapted to contain an initial volume and adapted to be reversibly moved from a closed position to an open position; (b) at least one light source disposed in the container; and (c) a collapsible envelope of a diffuser material disposed in the container, and adapted to be reversibly moved from a contained position defining a contained volume within the container when the container is in the closed position, to a deployed position wherein the collapsible envelope of a diffuser material defines a volume greater than the contained volume and extending outside the container, when the container is in the open position.

The collapsible envelope of a diffuser material may be deployed into any shape amenable to being reversibly collapsed and deployed, but typically and preferably will be fully deployed into a shaped that is generally curved or rounded, such as an ovoid, frusto-ovoid or spherical or a frusto-spherical shape around the light source(s). Other shape may be arcuate or umbrella-like shapes.

Typically, the ration of the initial volume to the greater deployed value is in the range of from about 1:2 to 1:4, though other volume ratios outside this range may be used.

In one embodiment, the lid portion is adapted to be twisted with respect to the base portion upon the container being moved to the open position. It may also be lifted upward or completely removed from the balance of the container, or slid to one side.

The collapsible envelope of a diffuser material may be urged into and held and supported in the fully deployed position by any appropriate collapsible structure, mechanism or means, such as a wire frame adapted to be reversibly moved from a closed position to an open position, and to maintain the collapsible envelope of a diffuser material in the deployed position when the container is in the open position, the wire frame adapted to be collapsed into the container when the container is in the closed position.

In a particular embodiment, the lid portion is adapted to be twisted with respect to the base portion upon the container being moved to the open position, and additionally comprising a wire coil adapted to be reversibly moved from a closed position to an open position, and to maintain the collapsible envelope of a diffuser material in the deployed position when the container is in the open position, the wire coil being attached to the portions, so as to be adapted to be collapsed into the container when the container is in the closed position by the twisting action.

The lighting device of the present invention may additionally comprise a frame adapted to be reversibly moved from a closed position to an open position, and to maintain the collapsible envelope of a diffuser material in the deployed position when the container is in the open position, the frame adapted to be collapsed into the container when the container is in the closed position. The frame may comprise a plurality of arcuate wires moveably attached to the container so as to be adapted to be collapsed into the container when the container is in the closed position by the twisting action.

In another variation, the frame comprises a plurality of resilient cords each extending though a plurality of rigid tubular pieces that form a rigid arcuate shape when each respective resilient cord is under extension, and moveably attached to the container so as to be adapted to be collapsed into the container when the container is in the closed position by the twisting action.

In still another embodiment, the lighting device may additionally comprise a fan adapted to move air from outside the container to within the collapsible envelope of a diffuser material so as to be capable of moving the collapsible envelope of a diffuser material from a contained position to a deployed position, and to maintain the collapsible envelope of a diffuser material in the deployed position when the container is in the open position. Likewise, any other form of contained air or active air pressure may be used in place of, or to supplement, the use of collapsible physical diffuser infrastructures, such as for example, those described herein.

Another embodiment of the lighting device of the present invention comprises a fan adapted to move air from outside the container to within the collapsible envelope of a diffuser material so as to be capable of moving the collapsible envelope of a diffuser material from a contained position to a deployed position, and to maintain the collapsible envelope of a diffuser material in the deployed position when the container is in the open position, and the fan adapted to reverse the flow of air from within the collapsible envelope of a diffuser material to outside the container, so as to be capable of moving the collapsible envelope of a diffuser material from the deployed position to the contained position. The fan system may be used alone or in conjunction with other physical frame elements, such as those described herein.

The present invention also includes a collapsible lighting device comprising: (a) a container having a base portion; (b) at least one light source disposed in the container; and (c) a collapsible envelope of a diffuser material disposed in the base portion, and adapted to be reversibly moved from a contained position within the base portion, to a deployed position.

The collapsible envelope of a diffuser material moves to the deployed position by being extended through an arc such that the collapsible envelope of a diffuser material defines a volume having a substantially sectioned spherical shape, when the collapsible envelope of a diffuser material is in the deployed position.

In a preferred version of this embodiment, the fan is adapted to move air from outside the container to within the collapsible envelope of a diffuser material so as to be capable of moving the collapsible envelope of a diffuser material from a contained position to a deployed position, and to maintain the collapsible envelope of a diffuser material in the deployed position.

It is also preferred that the fan is adapted to move air from outside the container to within the collapsible envelope of a diffuser material so as to be capable of moving the collapsible envelope of a diffuser material from the contained position to the deployed position, and to maintain the collapsible envelope of a diffuser material in the deployed position, and the fan adapted to reverse the flow of air from within the collapsible envelope of a diffuser material to outside the container, so as to be capable of moving the collapsible envelope of a diffuser material from the deployed position to the contained position.

The present invention also includes a collapsible lighting device comprising: (a) a container having a base portion and a lid portion, each the portion having a concave disk shape and adapted to contain an initial volume and adapted to be reversibly moved from a closed position to an open position; (b) at least one light source disposed in the container; and (c) a collapsible envelope of a diffuser material disposed in the container, and adapted to be reversibly moved from a contained position defining a contained volume within the container when the container is in the closed position, to a deployed position wherein the collapsible envelope of a diffuser material defines a volume greater than the contained volume and extending outside the container, when the container is in the open position, the collapsible envelope of a diffuser material having a substantially cylindrical shape.

It is preferred that the collapsible envelope of a diffuser material in the deployed position has a cylindrical shape around the at least one light source.

It is also preferred that the device additionally comprises at least one hinged support adapted to be reversibly moved from a closed position to an open position, and to maintain the collapsible envelope of a diffuser material in the deployed position when the container is in the open position, the hinged support adapted to be collapsed into the container when the container is in the closed position; most preferably including compressible or spring means adapted to urge the container toward the open position, such as through the use of sprung hinges or equivalent means.

In this embodiment the base portion and/or the lid portion, preferably both, comprises a translucent plastic material, such as a PVC plastic, depending upon the heat that is to be generated by the light source(s). For CFL bulbs, this is typically not enough heat to affect typical plastics that may be used. It is preferred that the translucence of the base portion and/or the lid portion be approximately that of the diffuser material, typically within about +/−10% to 20% translucence of that of the diffuser material.

The lighting device may be actuated into the open position by any collapsible resilient or sprung means attached to the base and lid portions to urge them apart and maintain them in the open position, such as by using at least one hinged support is attached to the portions, so as to be adapted to be collapsed into the container when the container is in the closed position. It is preferred that the light source(s) comprises a light bulb mounted on the hinged support, or otherwise mounted on a separate resilient or sprung platform such that the bulb(s) move relatively toward the center of the device when in the open position as the device moves into the open position.

The lighting device of the present invention may have the container adapted to be attached to a pole, such as through the use of a groove molded into the container with a hand set screw or interference cam built into it so as to be able to grasp the pole or other vertical structure.

The container may optionally be provided with a hook, such as on the lid portion, to allow it to be hung from any structure. A hook may also be placed along the side of the container to allow it to be hung while in the closed position. Such hooks or other attachment devices, arrangements or means may be integrated into the container.

It is preferred that the lid portion additionally comprises a handle.

The base portion may additionally include a retractable base extension, such as a tripod or the like, to allow the device to better rest upon a flat surface.

It is preferred that the diffuser material is releasably attached to said container to allow it to be conveniently replaced if damaged or soiled, or to allow it to be replaced by a diffuser material of a different nature (color, thickness, material, translucence, etc.), which may be provided as part of a kit or sold separately.

The present invention thus provides the integration of features that protect the diffuser, bulbs, etc. for storage and transportation.

With respect to any of the embodiments of the present invention involving flexible diffuser materials, any appropriate material may be used that provides the acceptable degree of translucence, flexibility and strength in accordance with the application and environment intended for the lighting device. Examples include materials such as those disclosed in U.S. Pat. Nos. 5,782,668; 6,012,826; 6,966,676; and 7,252,414, which are hereby incorporated herein by reference. The flexible diffuser materials may be tinted or colored depending upon the intended use, so as to present a most desirable or beneficial light, such as may be the case for interior painting or for decorative or entertainment use. In addition, as can be appreciated from the embodiments described herein, the flexible diffuser materials and the associated deployment and support mechanism may be made such that the flexible diffuser material may be replaced if damaged or soiled (such as in construction applications), or interchanged in order to alter the translucence and/or color characteristics of the light. This variation may be used to vary the amount of light and the nature of the light output. The flexible diffuser material may also be selected to vary the range and/or direction of light −360° vs. directional—by varying the opacity or translucence of all or sections of the flexible diffuser material. This provides the user the ability to control attributes of the light non-electrically.

With respect to any of the embodiments of the present invention, any one or more appropriate light source(s) may be used. Typically and preferably, these will be light bulbs of the incandescent or fluorescent type, including halogen, incandescent and compact fluorescent light (CFL) bulbs.

The light source(s) may be powered by any appropriate energy source, such as by batteries, rechargeable or otherwise, alternating current from line or from a generator, or from a hand-crank generator, as the requirements and limitations of the specific application dictate.

The device of the present invention may use one or more reflectors in a single or multi-bulb fixture to reduce light loss, or to focus/direct the light as require or as desirable.

DETAILED DESCRIPTION OF THE PREFERRED EMBODIMENTS

In accordance with the foregoing summary, the following describes a preferred embodiment of the present invention which is considered to be the best mode thereof. With reference to the drawings, the invention will be described in detail with regard for the best mode and preferred embodiments.

Figure 1:
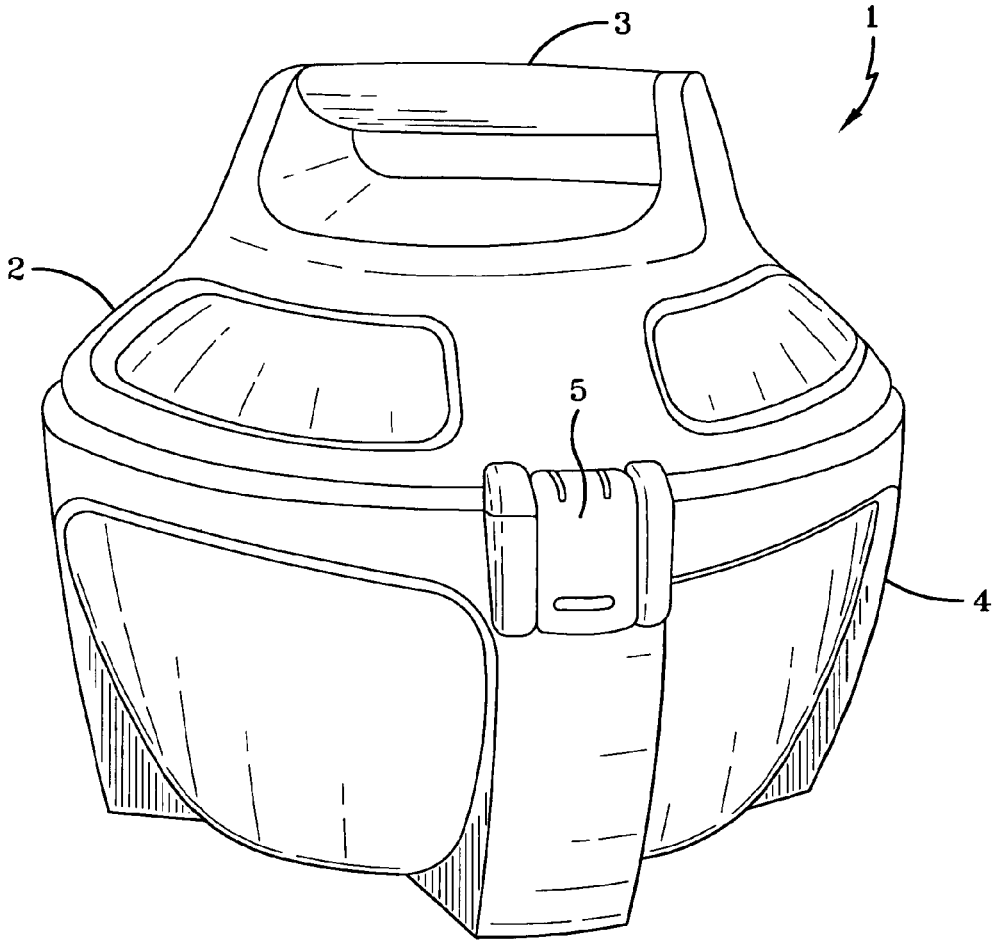
FIG. 1 is a side perspective view of a closed light device container, in accordance with one embodiment of the present invention.

FIG. 1 is a side perspective view of a closed light device container, in accordance with one embodiment of the present invention. FIG. 1 shows container 1 having a top portion 2, handle portion 3 and bottom portion 4. Top portion 2 and bottom portion 4 may be releasably held together such as by latch or clasp 5.

The containers and their constituent parts as used in accordance with the present invention may be made of a wide variety of materials, such as wood, metals and plastics, including PVC and ABS plastics, as each construction and application requires, and as will be apparent to those skilled in the art relating to containers of this type.

It will also be understood that the containers used in accordance with the present invention may have a wide variety of acceptable closure means, such as threaded and interference fits, such as snap- or twist-fit closures with the top and bottom portions sized and fitted according, and outfitted with corresponding parts and cooperating shapes, as are known and used in the container art.

Figure 2:
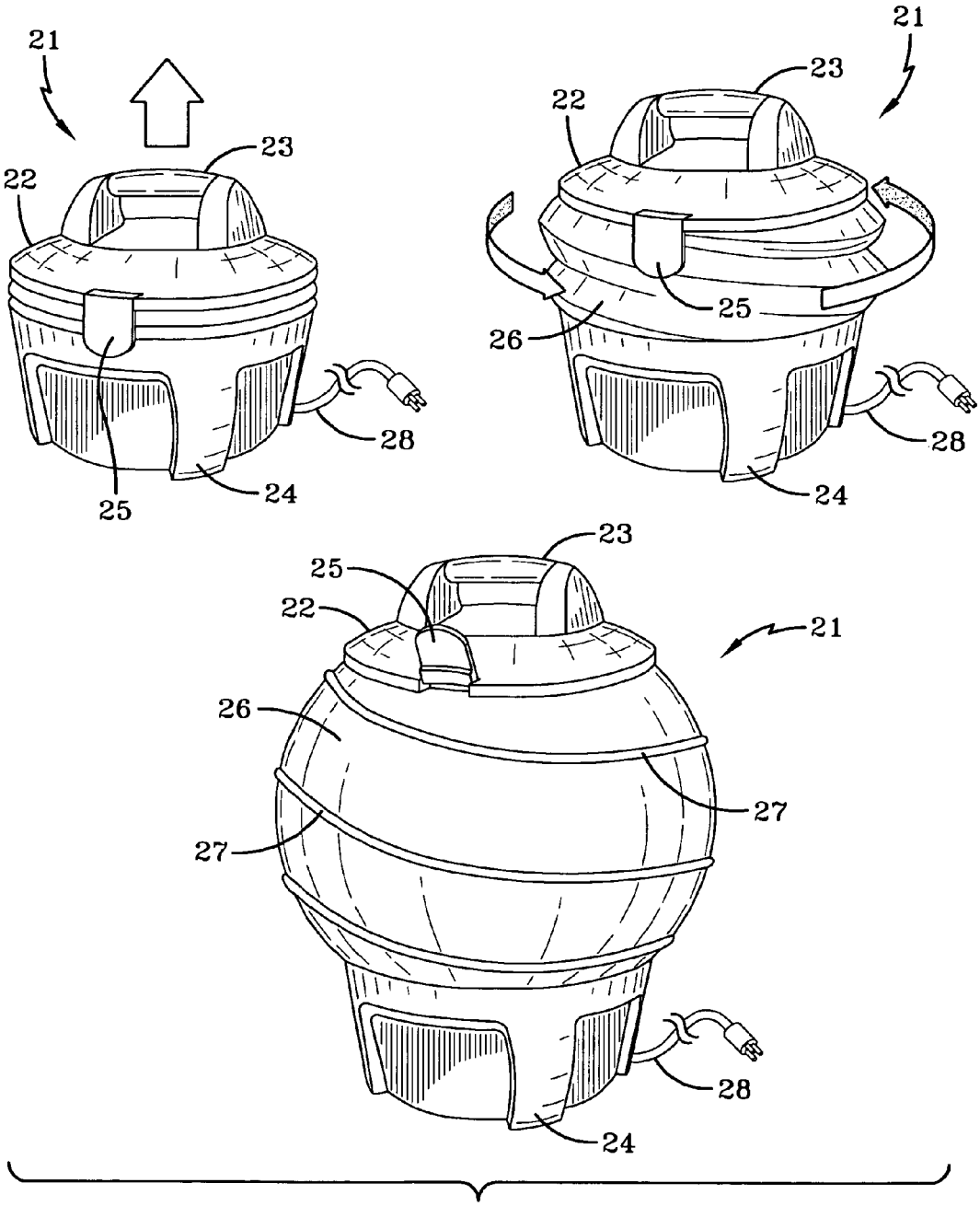
FIG. 2 is a side perspective view of a light device container, shown in a progression of steps from a closed position to an open position, in accordance with another embodiment of the present invention.

FIG. 2 is a side perspective view of a light device container, shown in a progression of steps from a closed position to an open position, in accordance with another embodiment of the present invention. FIG. 2 shows container 21 having a top portion 22, handle portion 23 and bottom portion 24. Top portion 22 and bottom portion 24 may be releasably held together such as by latch or clasp 25. FIG. 2 also shows how top portion 22 may be twisted with respect to bottom portion 24 after latch or clasp 25 is released to deploy the flexible diffuser material 26. The flexible diffuser material 26 is expanded from its contained position to the deployed position, and held in that position, by helical support rod(s) 27 that uncoil(s) and expand(s) as top portion 22 is twisted with respect to bottom portion 24, as indicated by the directional arrows in the Figure. The helical support rod(s) 27 may be attached to or may be incorporated into the flexible diffuser material 26. As the top portion 22 is twisted with respect to bottom portion 24 back to the closed position, the helical support rod(s) 27 collapse to allow the helical support rod(s) 27 and the flexible diffuser material 26 to be enclosed within the container. The flexible diffuser material 26 may be adapted to present a rounded or ovoid shape, depending upon the combined geometry of the flexible diffuser material 26 and the helical support rod(s) 27.

The helical support rod(s) 27 may be of any appropriate flexible and resilient material, such as wire, plastic, or similar material, that is adapted to be repeatedly bent and/or twisted in accordance with the described action and function.

The light(s) contained in the container 21 may be powered by an on-board battery or rechargeable battery, or a retractable power cord 28, or both.

In this embodiment, as the top portion lid lifts, the flexible structure rotates and expands to create diffuser shape. The container design protects the diffuser shroud when not in use, and closing the container tightens and reduces overall volume.

Figure 3:
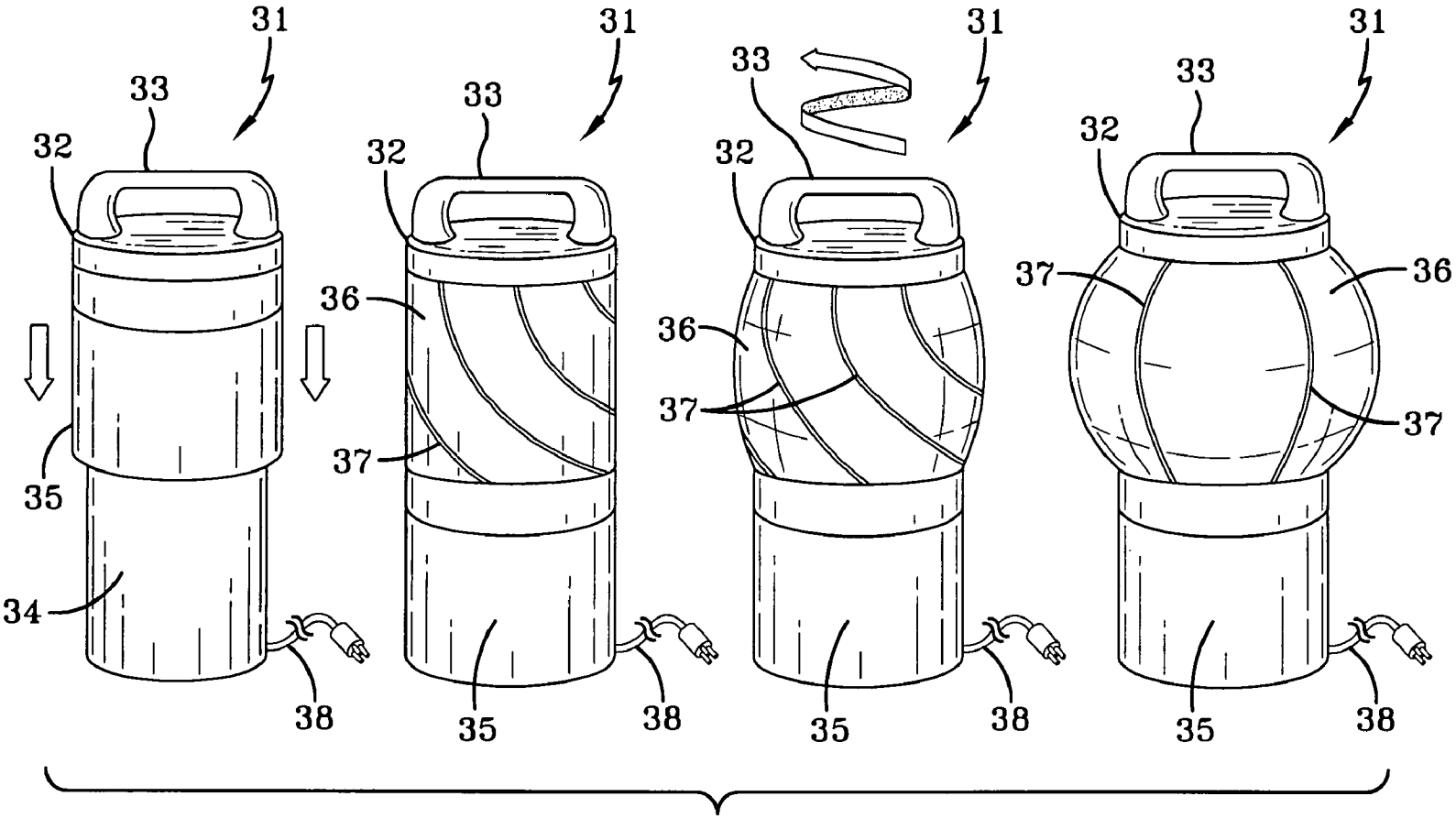
FIG. 3 is a side perspective view of a light device container, shown in a progression of steps from a closed position to an open position, in accordance with still another embodiment of the present invention.

FIG. 3 is a side perspective view of a light device container, shown in a progression of steps from a closed position to an open position, in accordance with still another embodiment of the present invention. FIG. 3 shows container 31 having a top portion 32, handle portion 33 and bottom portion 34. Top portion 32 and bottom portion 34 may be releasably held together such as by latch or clasp, or any other fixture adapted to releasably attach the two portions (not shown, but as is shown in other embodiments). FIG. 3 also shows how top portion 32 may be twisted with respect to bottom portion 34 after protector portion 35 (which may releasably engage top portion 32, such as through a light interference fit) is slid to an open position, as shown by the directional arrow in the Figure, to allow deployment of the flexible diffuser material 36. In this embodiment, the protector portion 35 may be locked or latched to top portion 32, and by virtue of its greater diameter, provides additional stability to the container when in the deployed position. The protector portion 35 may be made of polycarbonate-based or any other transparent or translucent plastic material.

The flexible diffuser material 36 is expanded from its contained position to the deployed position, and held in that position, by helical support rod(s) 37 that uncoil(s) and expand(s) as how top portion 32 may be twisted with respect to bottom portion 34, as shown by the directional arrow in the Figure. Opposite ends of the helical support rod(s) 37 may be attached to respective portions of the top portion 32 and bottom portion 34 as shown. The helical support rod(s) 37 may be attached to or may be incorporated into the flexible diffuser material 36. As the top portion 32 is twisted with respect to bottom portion 34 back to the closed position, the helical support rod(s) 37 collapse to allow the helical support rod(s) 37 and the flexible diffuser material 36 to be enclosed within the container. The flexible diffuser material 36 may be adapted to present a rounded or ovoid shape, depending upon the combined geometry of the flexible diffuser material 36 and the helical support rod(s) 37.

The helical support rod(s) 37 may be of any appropriate flexible and resilient material, such as wire, plastic, or similar material, that is adapted to be repeatedly bent and/or twisted in accordance with the described action and function.

The light(s) contained in the container 31 may be powered by an on-board battery or rechargeable battery, or a retractable power cord 38, or both.

Figure 4:
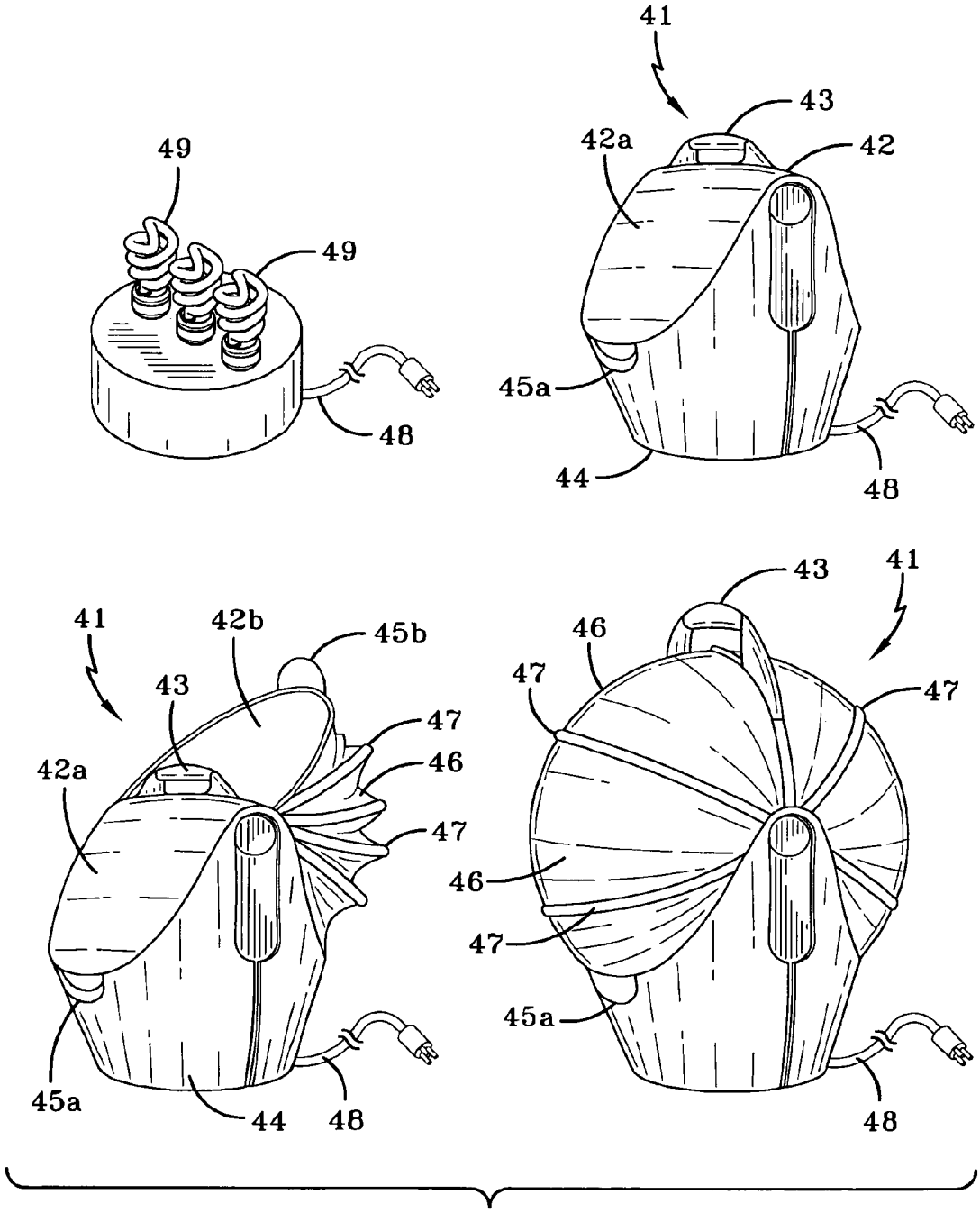
FIG. 4 is a side perspective view of a light device container, shown in a progression of steps from a closed position to an open position, in accordance with yet another embodiment of the present invention.

FIG. 4 is a side perspective view of a light device container, shown in a progression of steps from a closed position to an open position, in accordance with yet another embodiment of the present invention. FIG. 4 shows container 41 having a top portion 42, handle portion 43 and bottom portion 44. Top portion 42 and bottom portion 44 may be releasably held together such as by latches or clasps 45*a* and 45*b*. FIG. 4 also shows how top portions 42*a* and 42*b* may be opened with respect to bottom portion 44 after latches or clasps 45*a* and 45*b* (which may releasably engage top portion 42) are released to deploy both halves of the flexible diffuser material 46. In this embodiment, the latches or clasps 45*a* and 45*b* may be locked or latched to bottom portion 44 to maintain both halves of the flexible diffuser material 46 folded in an accordion fashion as shown.

The flexible diffuser material 46 is expanded in an accordion fashion from its contained position to the deployed position, and held in that position, by arcuate support rods 47 that unfold and expand as top portions 42*a* and 42*b* are raised with respect to bottom portion 44. Top portions 42 and 42*a* may be mated at the top of the device as latches or clasps 45*a* and 45*b* are attached to one another, and handle 43 may be telescoped into a higher open position above the open flexible diffuser material 46.

The arcuate support rods 47 may be attached to or may be incorporated into the flexible diffuser material 46. As the top portions 42*a* and 42*b* are folded down onto bottom portion 44 back to the closed position, the arcuate support rods 47 collapse in an accordion fashion to allow themselves and the flexible diffuser material 46 to return to the closed position within bottom portion 44. The flexible diffuser material 46 may be adapted to present a rounded or ovoid shape, depending upon the combined geometry of the flexible diffuser material 46 and the arcuate support rods 47.

The arcuate support rods 47 may be of any appropriate rigid or flexible and resilient material, such as wire, plastic, or similar material, that is adapted to be repeatedly moved between the deployed and closed position as shown. It may be preferred to use materials that may be bent and/or twisted to allow the lighting device to rebound from incidental contact when in the deployed position, in accordance with the described action and function.

In this embodiment, the light and all components are protected inside a solid shell. The diffuser material opens to form a balloon shape, similar to a soft convertible top for an automobile. When stored, the container case protects the diffuser material. This embodiment may use either a nested hard shell or flexible soft shell diffuser material.

The light(s) contained in the container 41 may be powered by an on-board battery or rechargeable battery, or a retractable power cord 48, or both.

FIG. 4 also shows the in-board light source, such as 3 CFL bulbs 49.

Figure 5:
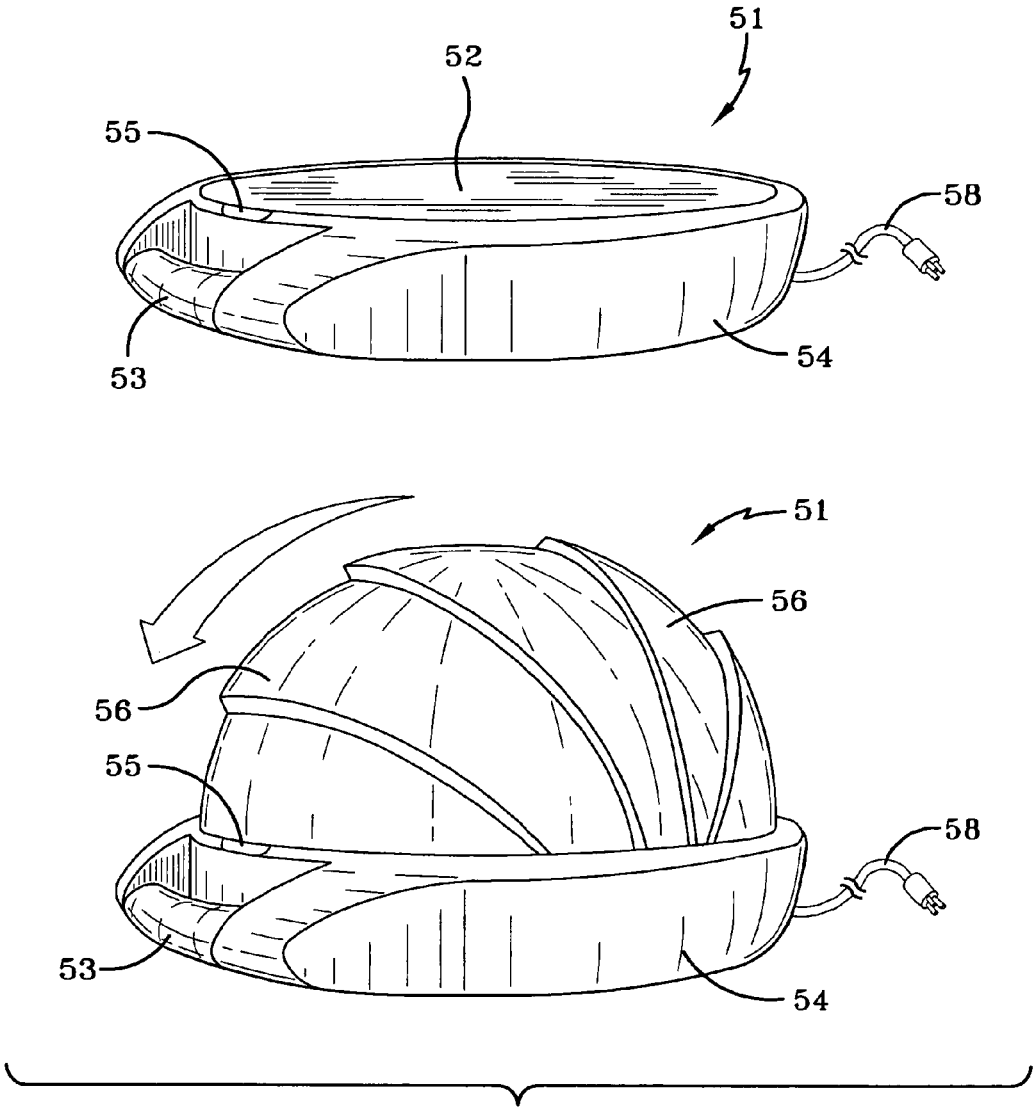
FIG. 5 is a side perspective view of a light device container, shown being moved from a closed position to an open position, in accordance with still another embodiment of the present invention.

FIG. 5 is a side perspective view of a light device container, shown being moved from a closed position to an open position, in accordance with still another embodiment of the present invention. FIG. 5 shows container 51 having a bottom portion 54 having handle portion 53. Bottom portion 54 holds a series of nested rigid or resilient diffuser portions 56 that may be releasably held together in bottom portion 54 by a latch or clasp 55. The device of FIG. 5 may be provided with a top portion 52 that may be opened with respect to, or completely removed from, bottom portion 54 after latches or clasps 55 (which may releasably engage top portion 52) is released to deploy rigid or resilient diffuser portions 56, as indicated by the directional arrow in the Figure. In this embodiment, the latch or clasp 55 may be locked or latched to hold top portion 52 to bottom portion 54 to maintain the rigid or resilient diffuser portions 56 folded in a nested fashion as shown.

The rigid or resilient diffuser portions 56 are expanded from their nested contained position to the deployed position, and held in that position, by action of an interference fit that maintains them in the fixed open position which may be attained (and released) by hand force. The rigid or resilient diffuser portions 56 may be folded down into bottom portion 54 to return it back to the closed position. The rigid or resilient diffuser portions 56 may be adapted to present a rounded or ovoid shape, depending upon the combined geometry of the rigid or resilient diffuser portions 56 and the bottom portion 54.

The rigid or resilient diffuser portions 56 typically will be made by plastic self-shaping materials having a translucent diffusive character, such as arcuate-shaped, frosted plastic panels.

The light(s) contained in the container 51 may be powered by an on-board battery or rechargeable battery, or a retractable power cord 58, or both.

This embodiment features a hard shell diffuser that is more durable than fabric diffusers. The layered "petals" 56 retract into housing for transportation or storage, offering a relatively low profile design.

Figure 6:
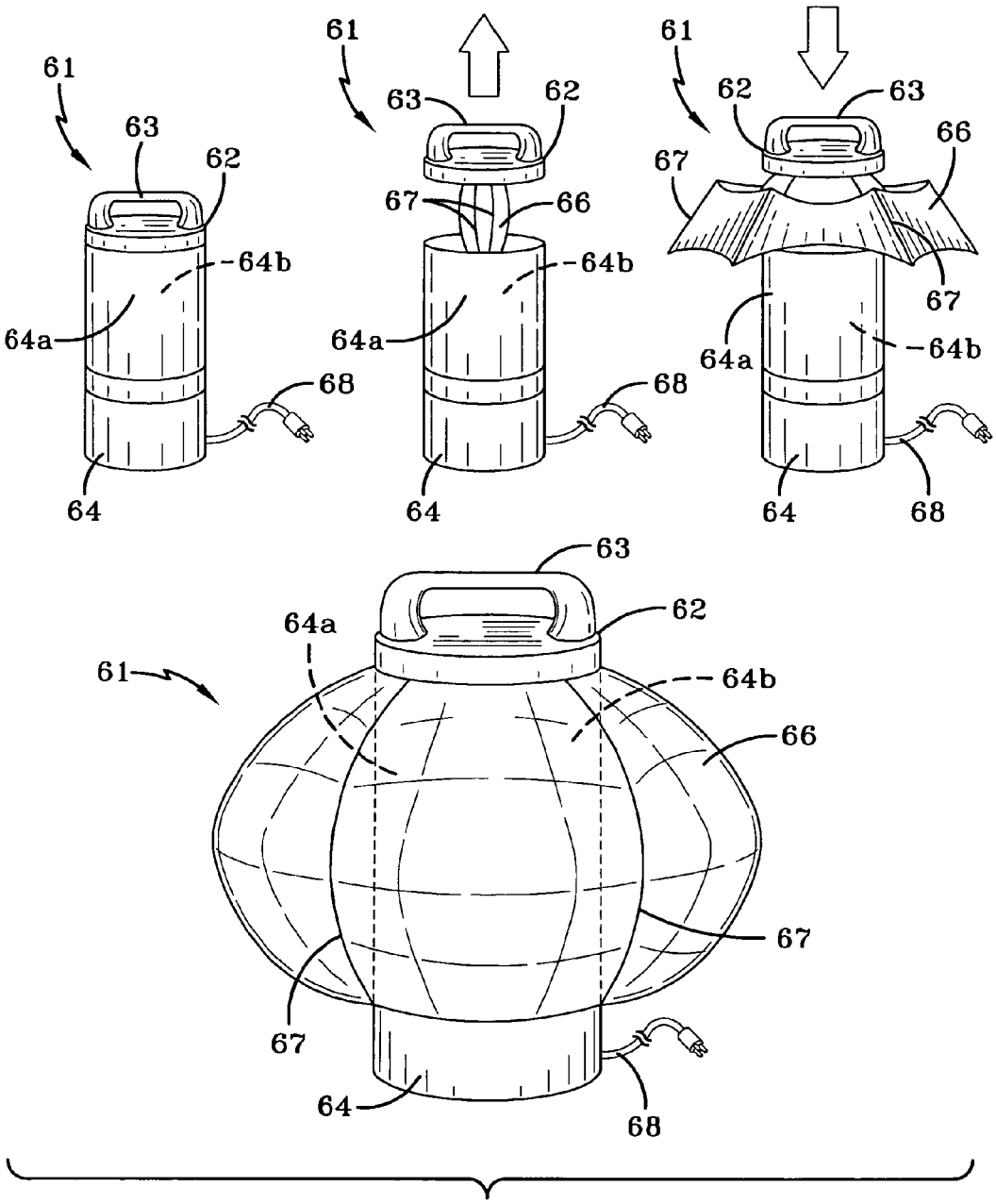
FIG. 6 is a side perspective view of a light device container, shown in a progression of steps from a closed position to an open position, in accordance with yet another embodiment of the present invention.

FIG. 6 is a side perspective view of a light device container, shown in a progression of steps from a closed position to an open position, in accordance with yet another embodiment of the present invention. FIG. 6 shows container 61 having a top portion 62, handle portion 63 and bottom portion 64. Top portion 62 and bottom portion 64 may be releasably held together such as by latch or clasp, or a snap-fit portion. The bottom portion 64 may also include a transparent portion 64*a* that allows the light to issue from the interior of the container where the light source(s) is/are housed. FIG. 6 also shows how top portion 62 may be twisted or simply raised, along the direction arrows shown in the Figure, with respect to bottom portion 64 (which may releasably engage top portion 62) to an open position to allow deployment of the flexible diffuser material 66, which deploys in the nature of an umbrella and reaches a fully deployed position.

The flexible diffuser material 66 is expanded from its contained position in tubular portion 64*b* to the deployed position, and held in that position, by umbrella-action support rod(s) 67 that uncoil(s) and expand(s) as top portion 62 is twisted with respect to bottom portion 64. The umbrella-action support rod(s) 67 may be attached to or may be incorporated into the flexible diffuser material 66. As the top portion 62 is slid or twisted downward with respect to bottom portion 64 back to the closed position, the umbrella-action support rod(s) 67 collapse to allow the umbrella-action support rod(s) 67 and the flexible diffuser material 66 to be enclosed within the container. The flexible diffuser material 66 may be adapted to present a rounded or ovoid shape, depending upon the combined geometry of the flexible diffuser material 66 and the umbrella-action support rod(s) 67.

The umbrella-action support rod(s) 67 may be of any appropriate flexible and resilient material capable of acting in an umbrella-action fashion, such as jointed wire, plastic, or similar material, that is adapted to be repeatedly flexed in accordance with the described umbrella-action and function.

The light(s) contained in the container 61 may be powered by an on-board battery or rechargeable battery, or a retractable power cord 68, or both.

The umbrella-like mechanism may be stored in the device's center post and the reversible vertical motion exposes the diffuser and activates the mechanism. The deployed diffuser material may be open on the bottom that may aid in cooling the device.

Figure 7:
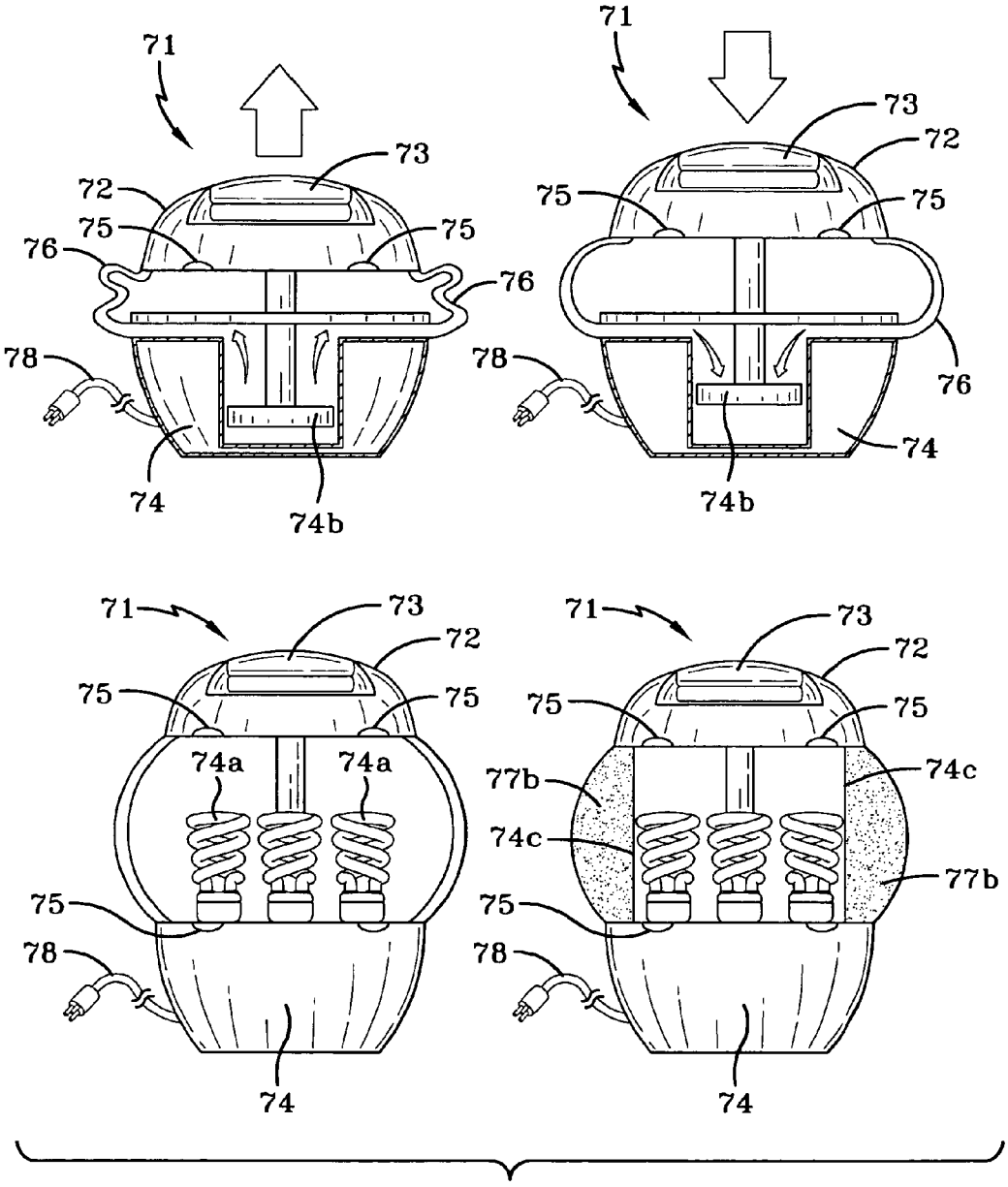
FIG. 7 is a side perspective view of a light device container, shown in a progression of steps from a closed position to an open position, in accordance with still another embodiment of the present invention.

FIG. 7 is a side perspective view of a light device container, shown in a progression of steps from a closed position to an open position, in accordance with still another embodiment of the present invention. FIG. 7 shows an example of an inflatable variation of the present invention. FIG. 7 shows container 71 having a top portion 72, handle portion 73 and bottom portion 74. Top portion 72 and bottom portion 74 may be releasably held together such as by latch or clasp, or a snap-fit portion 75. The bottom portion 74 may contain the light source(s), such as the three CFL bulbs 74*a*. FIG. 7 also shows how top portion 72 may be twisted or simply raised with respect to bottom portion 74 (which may releasably engage top portion 72), as indicated by the directional arrows in the Figure, to an open position to allow deployment of the flexible diffuser material 76 which deploys in the nature of an inflatable diffuser material that reaches a fully deployed position through action of an air plunger 74*b* portion as shown that provides air into the inflatable diffuser material 76 that has an inner and outer layer to form air cells to be filled and made rigid to reach the final deployed shape. As an alternative, the bottom portion 74 may be provided with electric fan that is activated by a switch upon opening of the container and which actively inflates and maintains the inflatable diffuser material 76 in a fully deployed position.

The flexible diffuser material 76 is expanded from its contained position to the deployed position, and held in that position, by air pressure and or the action of optional air pockets 77 that unfold and expand as top portion 72 is twisted or raised with respect to bottom portion 74. In design option A, the optional air pockets 77 may be attached to or may be incorporated into the flexible diffuser material 76 as shown for additional shaping rigidity. In design option B, a rigid portion 74*c* is transparent and serves as a backing for the flexible diffuser material 76 that expands and contracts with the aid of air pockets 77*b* as shown.

As the top portion 72 is slid or twisted downward with respect to bottom portion 74 back to the closed position, the optional air pockets 77 collapse to allow the flexible diffuser material 76 to be enclosed within the container. The flexible diffuser material 76 may be adapted to present a rounded or ovoid shape, depending upon the combined geometry of the flexible diffuser material 76 and the rigid portion 74*c*, where provided.

The flexible diffuser material 76 and optional air pockets 77*b* may be of any appropriate flexible and resilient material capable of acting in a balloon-like fashion or expansive fashion from a compressed state, such as using small arcuate sections as shown in option A, of semi-circular sections as in option B, which is adapted to be repeatedly flexed in accordance with the described balloon-like fashion or expansive fashion and function.

The light(s) contained in the container 71 may be powered by an on-board battery or rechargeable battery, or a retractable power cord 78, or both.

Inflatable variations of the present invention may also be adapted to minimize air volume and/or isolate light source from inflation. Inflation/deflation may be integrated into open/close mechanism, such as thorough the use of an air pump mechanism or a switched fan unit.

Figure 8:
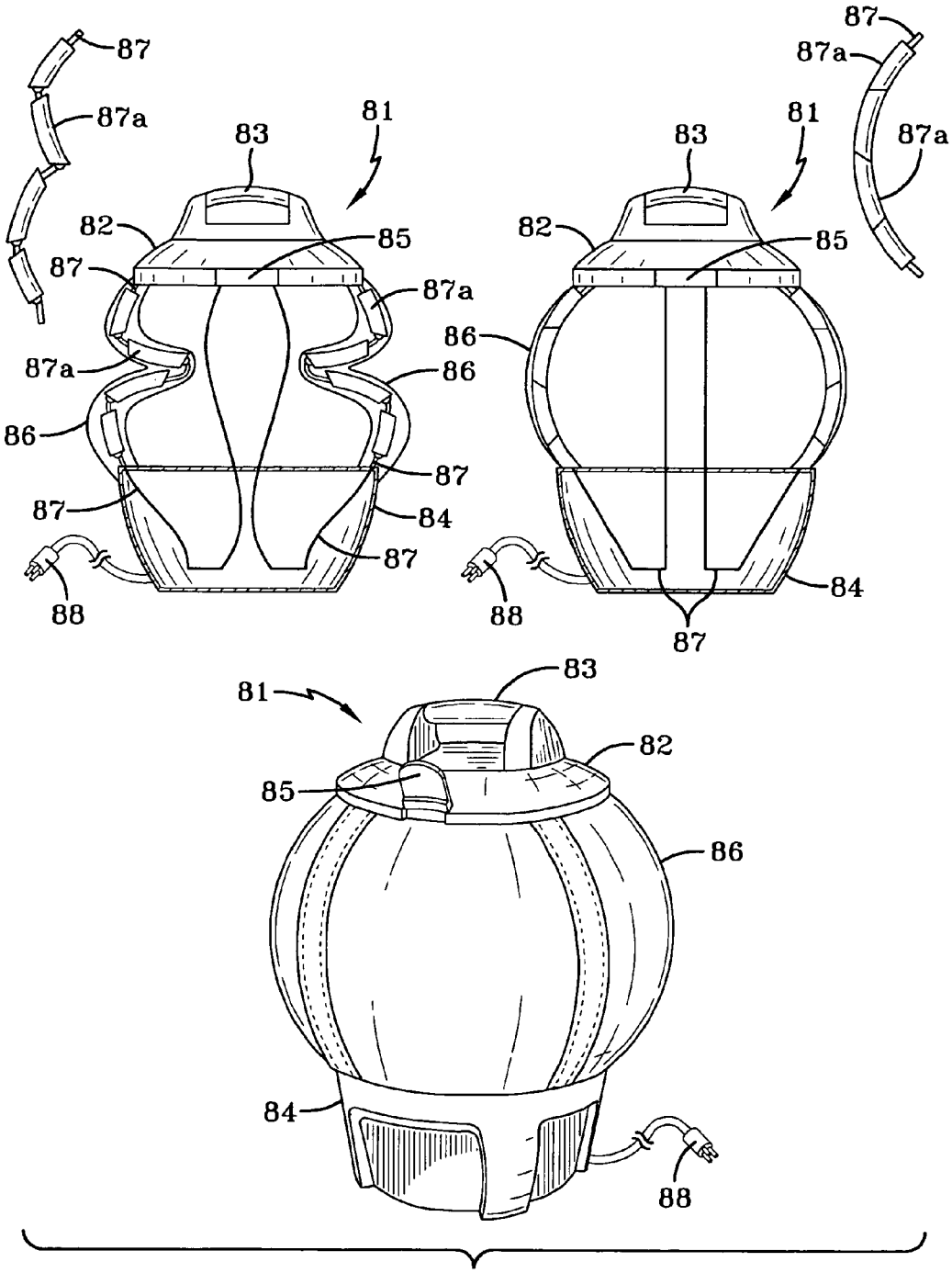
FIG. 8 is a side perspective view of a light device container, shown in a progression of steps from a closed position to an open position, in accordance with a further embodiment of the present invention.

FIG. 8 is a side perspective view of a light device container, shown in a progression of steps from a closed position to an open position, in accordance with a further embodiment of the present invention. FIG. 8 shows container 81 having a top portion 82, handle portion 83 and bottom portion 84. Top portion 82 and bottom portion 84 may be releasably held together such as by latch or clasp 85. FIG. 8 also shows how top portion 82 may be lifted or twisted upward with respect to bottom portion 84 after latch or clasp 85 is released to deploy the flexible diffuser material 86. The flexible diffuser material 86 is expanded from its contained position to the deployed position, and held in that position, by flexible support bands 87 (with arcuate rigid hollow pieces 87*a*) that unfold and expand as how top portion 82 may be twisted with respect to bottom portion 84. The flexible support bands 87 may be attached to or may be incorporated into the flexible diffuser material 86, as shown in the portion of the Figure showing the fully deployed flexible diffuser material 86. As the top portion 82 is twisted downward or otherwise lowered onto bottom portion 84, back to the closed position, the flexible support bands 87 collapse to allow the flexible support bands 87 and the flexible diffuser material 86 to be enclosed within the container. The flexible diffuser material 86 may be adapted to present a rounded or ovoid shape, depending upon the combined geometry of the flexible diffuser material 86 and the flexible support bands 87 with arcuate rigid hollow pieces 87*a*.

The flexible support bands 87 may be of any appropriate flexible and resilient material, such as rubber or similar material, which is adapted to be repeatedly bent and/or twisted in accordance with the described action and function.

The light(s) contained in the container 81 may be powered by an on-board battery or rechargeable battery, or a retractable power cord 88, or both.

In this embodiment, tension of cable creates rigid tube design, while slacking allows the support tubes to collapse. The open/close mechanism may be used to activate the tension/slack mechanism.

Figure 9:
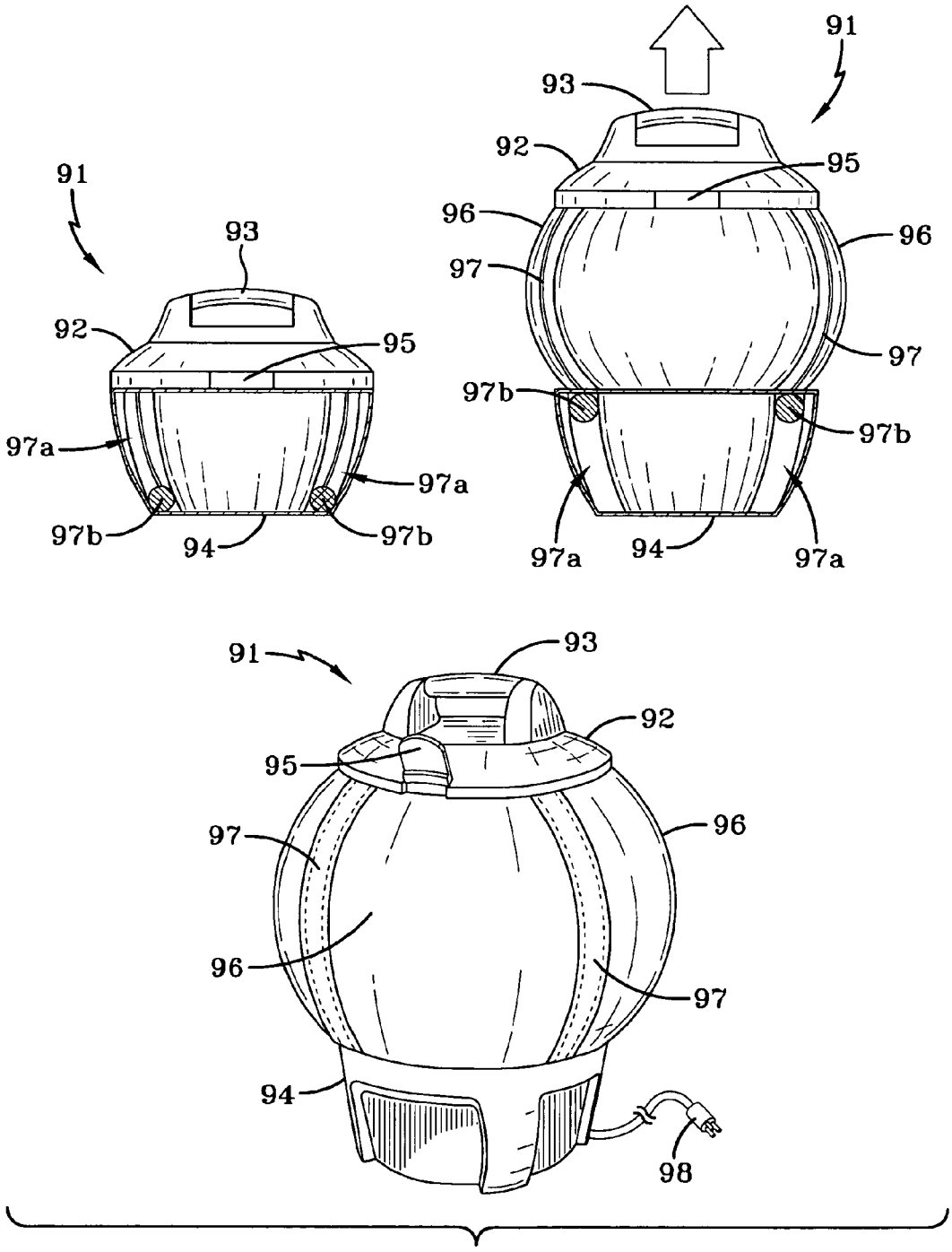
FIG. 9 is a side perspective view of a light device container, shown in a progression of steps from a closed position to an open position, in accordance with yet another embodiment of the present invention.

FIG. 9 is a side perspective view of a light device container, shown in a progression of steps from a closed position to an open position, in accordance with yet another embodiment of the present invention. FIG. 9 shows container 91 having a top portion 92, handle portion 93 and bottom portion 94. Top portion 92 and bottom portion 94 may be releasably held together such as by latch or clasp, or a snap-fit portion 95. FIG. 9 also shows how top portion 92 may be raised with respect to bottom portion 94 (which may releasably engage top portion 92) to an open position to allow deployment of the flexible diffuser material 96, which deploys in the nature of a balloon and reaches a fully deployed position, by action of an inboard fan, preferably in the container bottom that is actuated by a switch (not shown), such as an outboard switch or an inboard, lid actuated switch.

The flexible diffuser material 96 is expanded from its contained position to the deployed position, and held in that position, by flexible support rod(s) 97 that flex outwardly and expand as top portion 92 is raised with respect to bottom portion 94, such as along the directional arrow shown in the Figure. The flexible support rod(s) 97 reach their maximum deployment extent and may be limited such as by the interfering action of end knobs 97*b*. The flexible support rod(s) 97 may supplement or replace air pressure to deploy and support the flexible diffuser material 96. The expanding action support rod(s) 97 may be attached to or may be incorporated into the flexible diffuser material 96. As the top portion 92 is moved downward with respect to bottom portion 94 back to the closed position, the expanding action support rod(s) 97 collapse, such as along provided grooves or slots 97*a* to allow the expanding action support rod(s) 97 and the flexible diffuser material 96 to be enclosed within the container.

The flexible diffuser material 96 may be expanded from its contained position to the deployed position, and held in that position, by contained or active air pressure from a fan or pump. As the top portion 92 is moved downward with respect to bottom portion 94 back to the closed position, the air pressure may be released such as through exhaust valves or reverse action of the provided fan to collapse the flexible diffuser material 96 so that it may be enclosed within the container. The flexible diffuser material 96 may be adapted to present a rounded or ovoid shape, depending upon the combined geometry of the flexible diffuser material 96, and the expanding action support rod(s) 97 where provided.

The expanding action support rod(s) 97 may be of any appropriate flexible and resilient material capable of acting in an expanding fashion, such as jointed wire, plastic, or similar material, that is adapted to be repeatedly flexed in accordance with the described expanding action and function.

The light(s) contained in the container 91 may be powered by an on-board battery or rechargeable battery, or a retractable power cord 98, or both.

The expanding action mechanism may be stored in the device's bottom portion, such as in tubes, slots or grooves, such as 97*a*, in the bottom portion 94, and the reversible vertical motion exposes the diffuser and activates the mechanism. The deployed diffuser material 96 or the container 91 may be open on the bottom or top with vents that may aid in cooling the device.

In this embodiment, the flexible diffuser supporting members may rest inside lower housing tracks in the bottom portion such that, when the device opens, the members snap into place and form the fully deployed diffuser shape.

Figure 10:
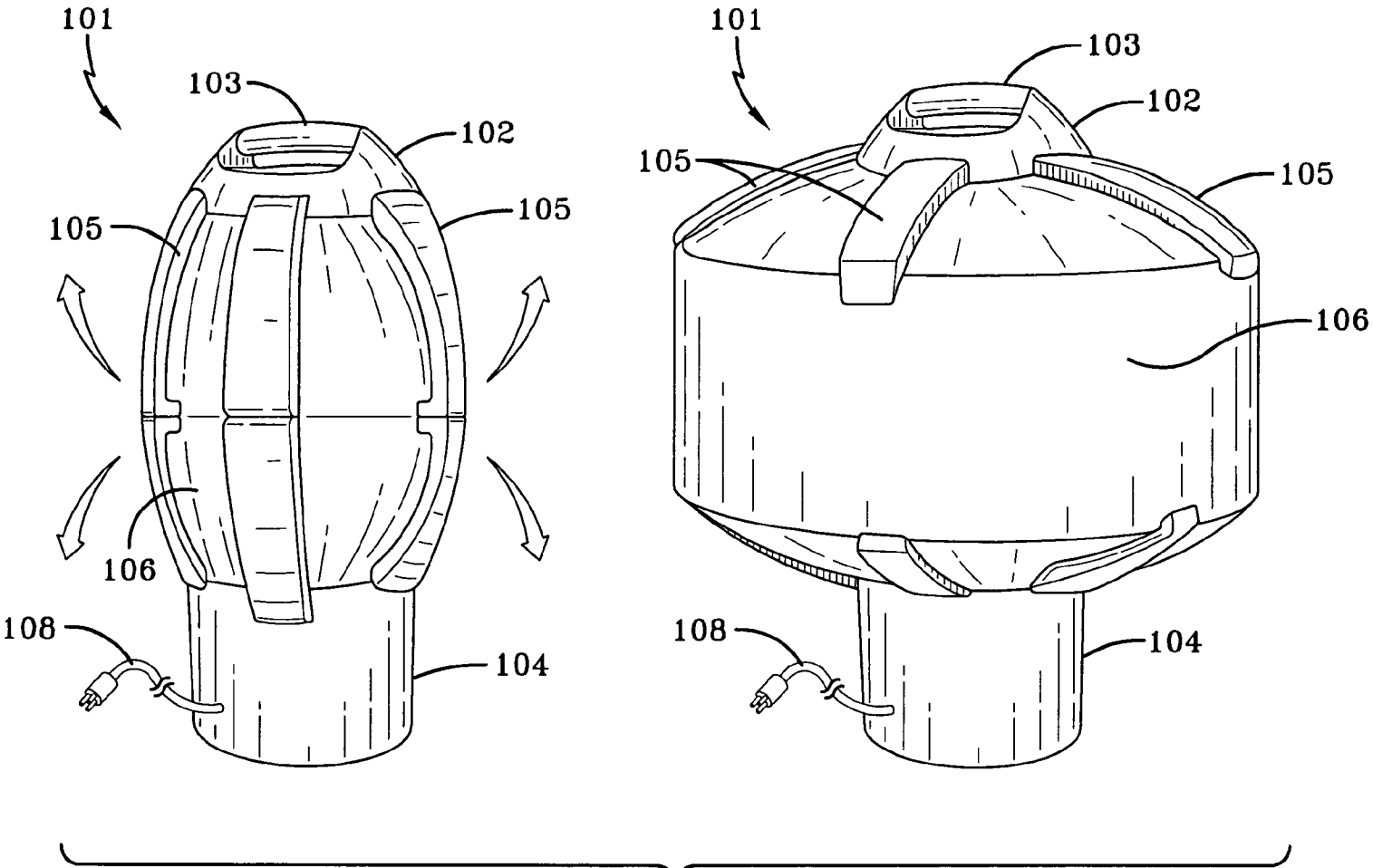
FIG. 10 is a side perspective view of a light device container, shown being moved from a closed position to an open position, in accordance with still another embodiment of the present invention.

FIG. 10 is a side perspective view of a light device container, shown in a progression of steps from a closed position to an open position, in accordance with yet another embodiment of the present invention. FIG. 10 shows container 101 having a top portion 102, handle portion 103 and bottom portion 104. Top portion 102 and bottom portion 104 may be releasably held together such as by latch or clasp, or a snap-fit portion. FIG. 10 also shows how top portion 102 may be raised with respect to bottom portion 104 (which may releasably engage top portion 102), or otherwise actuated such that moveable extension portions 105 move to an open position to allow deployment of the flexible diffuser material 106, which deploys in the nature of an umbrella or balloon and reaches a fully deployed position, by action of the moveable extension portions 105 and/or an inboard fan, preferably in the container bottom that is actuated by a switch (not shown), such as an outboard switch or an inboard, lid actuated switch.

The flexible diffuser material 106 is expanded from its contained position to the deployed position, and held in that position, by the moveable extension portions 105 that are internally hinged and reach outwardly and expand as top portion 102 is raised with respect to bottom portion 104, such that the flexible diffuser material 106 is deployed along the directional arrow shown in FIG. 10. The internal hinge or equivalent mechanism may be adapted to respond to the upward movement of the handle portion with respect to the bottom portion of the container. This may be done by any appropriate mechanical arrangement or linkage, and this may also be assisted by air pressure provided by an internal fan or mechanical pump adapted to bring air pressure to bear into the interior of the diffuser. A mechanical pump may be incorporated into a central stalk extending though the center of the container, such as is shown in the other embodiments. As an alternative, the arms and diffuser may be moved solely by use of air movement and/or pressure such as that provided by an internal fan or mechanical pump. The moveable extension portions 105 reach their maximum deployment extent and may be limited such as by the interfering action of the top portion 102. The moveable extension portions 105 may supplement or replace air pressure to deploy and support the flexible diffuser material 106. The expanding moveable extension portions 105 may be attached to or may be incorporated into the flexible diffuser material 106. As the top portion 102 is moved downward with respect to bottom portion 104 back to the closed position, the moveable extension portions 105 reverse direction and collapse, so as to return the flexible diffuser material 106 to be enclosed within the container.

The flexible diffuser material 106 also may be expanded from its contained position to the deployed position, and held in that position, by contained or active air pressure from a fan or pump. As the top portion 102 is moved downward with respect to bottom portion 104 back to the closed position, the air pressure may be released such as through exhaust valves or reverse action of the provided fan to collapse the flexible diffuser material 106 so that it may be enclosed within the container. The flexible diffuser material 106 may be adapted to present a rounded or ovoid shape, depending upon the combined geometry of the flexible diffuser material 106, and the expanding moveable extension portions 105.

The expanding moveable extension portions 105 may be of any appropriate flexible and resilient material capable of acting in an expanding fashion, such as jointed wire, plastic, or similar material, that is adapted to be repeatedly flexed in accordance with the described expanding action and function.

The light(s) contained in the container 101 may be powered by an on-board battery or rechargeable battery, or a retractable power cord 108, or both.

The deployed diffuser material 106 or the container 101 may be open on the bottom or top with vents that may aid in cooling the device.

In this embodiment, lifting of top forces top and bottom arms to extend, creating diffuser shape. The tabs on end of arms act to fold diffuser in when closed, while the extension arms protect the diffuser material during storage and transit.

Figure 11:
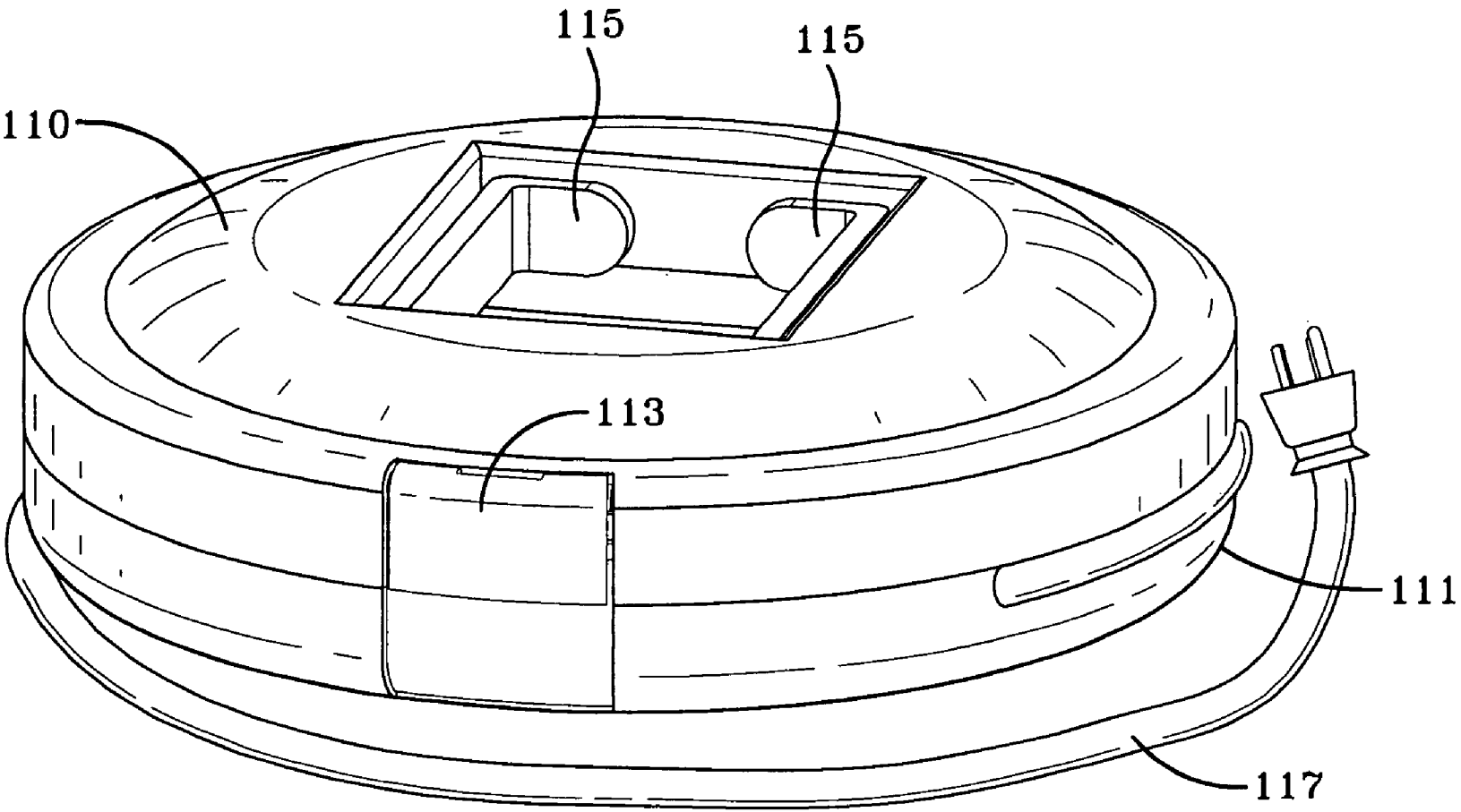
FIG. 11 is a side elevation view of a light device container, shown in a closed position, in accordance with still another embodiment of the present invention.

FIG. 11 is a side elevation view of a light device container, shown in a closed position, in accordance with still another embodiment of the present invention. FIG. 11 shows top portion 110 and bottom portion 111. These portions may be held in the closed position by any appropriate closure means, such as clasp 113 and opposing clasp 114 (not shown in this Figure). Also shown in this Figure are optional handles 115. Identical handles 116 (not shown in this Figure) may also be used in bottom portion 111 which may be extended to form a support base for the device when in the horizontal orientation. An electrical cord 117 adapted to supply electricity to the light source (typically from one to four light bulbs, preferably CFL bulbs). The bulbs may be placed in any configuration, but preferably will be arranged in such a way to provide light from the center of the device when in the open or closed position. Such arrangements may be nested arrangements or other arrangements whereby the light bulbs may move toward the center of the device upon opening, such as upon retractable supports or sprung supports or upon the support members as described herein. The cord 117 may be stored by winding it so that it may fit within the device, or it may be wound around the device when in the closed position, such as upon capture fittings and the like (not shown), such as are known and used in the field of electric devices, such as those that may be attached to or molded into the outer surface of the top portion 110 and/or bottom portion 111.

Figure 12:
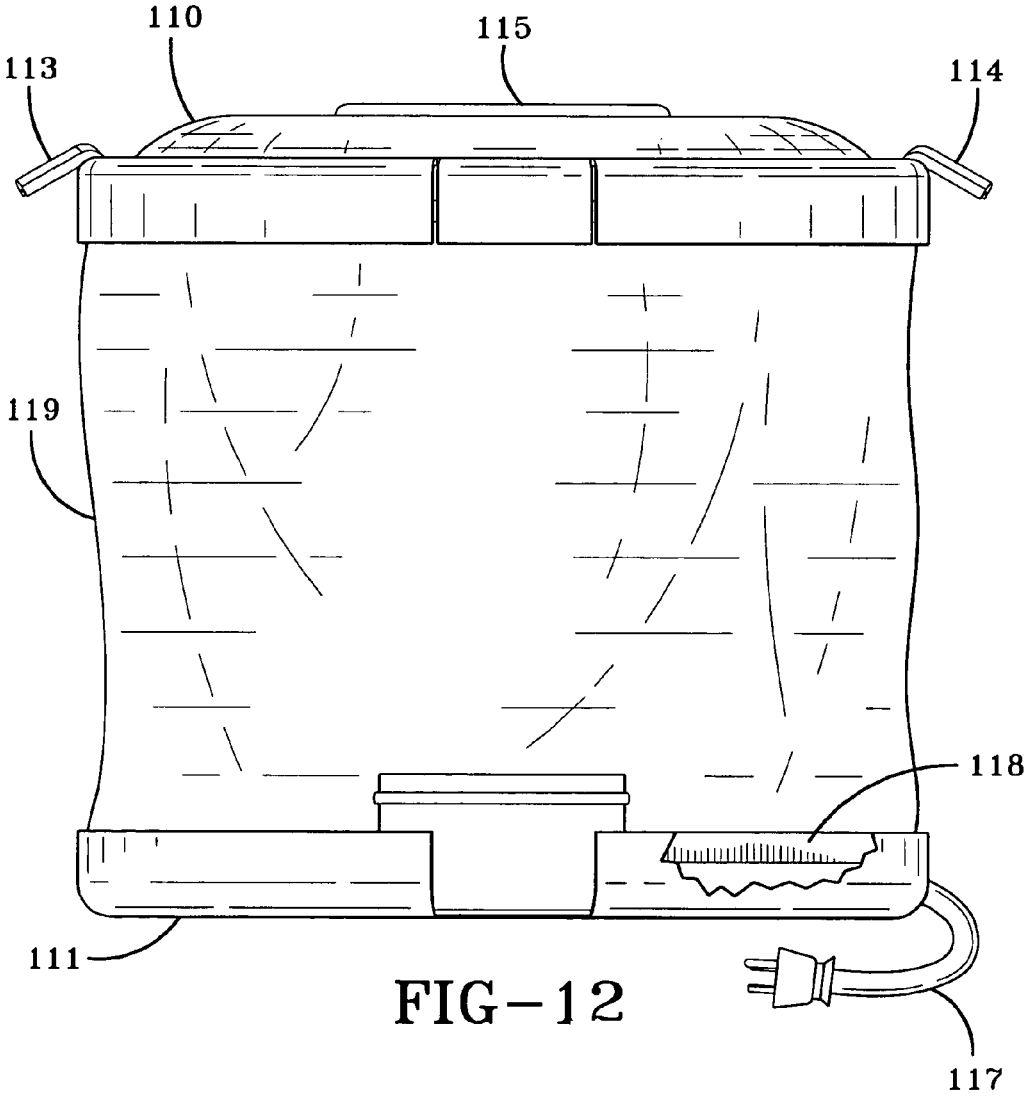
FIG. 12 is a side elevation view of a light device container, shown in an open position, in accordance with still another embodiment of the present invention.

FIG. 12 is a side elevation view of a light device container, shown in an open position, in accordance with still another embodiment of the present invention. Reference numerals identical to those used in FIG. 11 are used in this Figure. This Figure also shows clasp 113 and opposing clasp 114 that engage corresponding portions of bottom portion 111 and snap to maintain the device in the closed position.

This Figure shows diffuser material in the form of a cylindrical drape 119 that is attached, preferably removably attached, to the top portion 110 and bottom portion 111, preferably along the interior edge. This may be done by use of hook-and-loop strips, such as strip 118, and a corresponding strip, along the interior edge of the top portion 110 and bottom portion 111. Cylindrical drape 119 preferably is sized so as to be substantially taut in the open position, while able to be retracted and stored in the device upon closing. It is preferred that the diffuser material be a material that can withstand heat, and may be replaced if damaged or soiled. An example of such material may be rip-stop nylon (coated or uncoated with plastic), or similar materials such as woven fiberglass, linen or the like (which materials may be acceptable depending upon the desired application).

Figure 13:
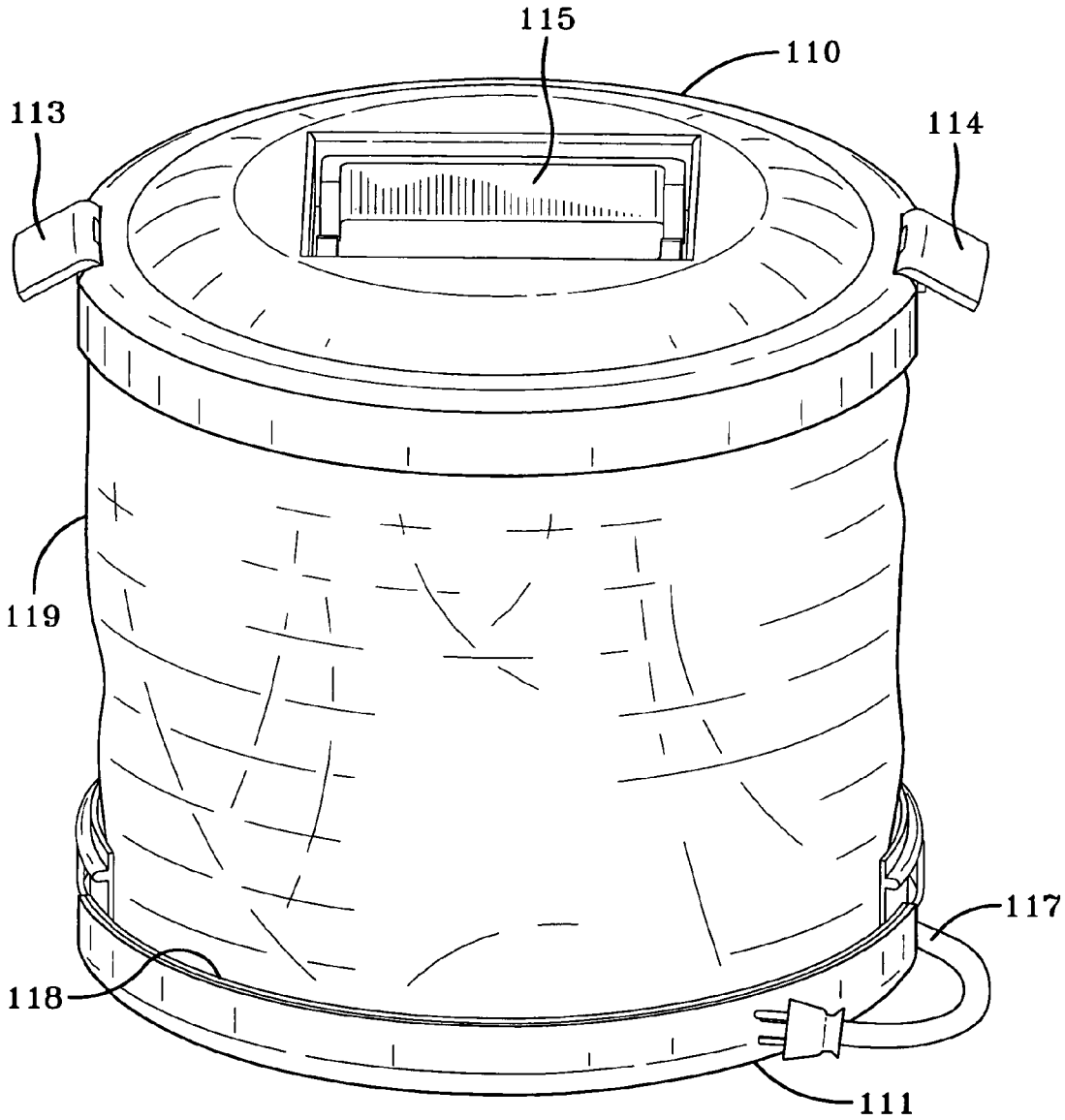
FIG. 13 is a side perspective view of a light device container, shown in an open position, in accordance with still another embodiment of the present invention.

FIG. 13 is a side perspective view of a light device container, shown in an open position, in accordance with still another embodiment of the present invention. Reference numerals identical to those used in FIGS. 11 and 12 are used in this Figure.

Figure 14:
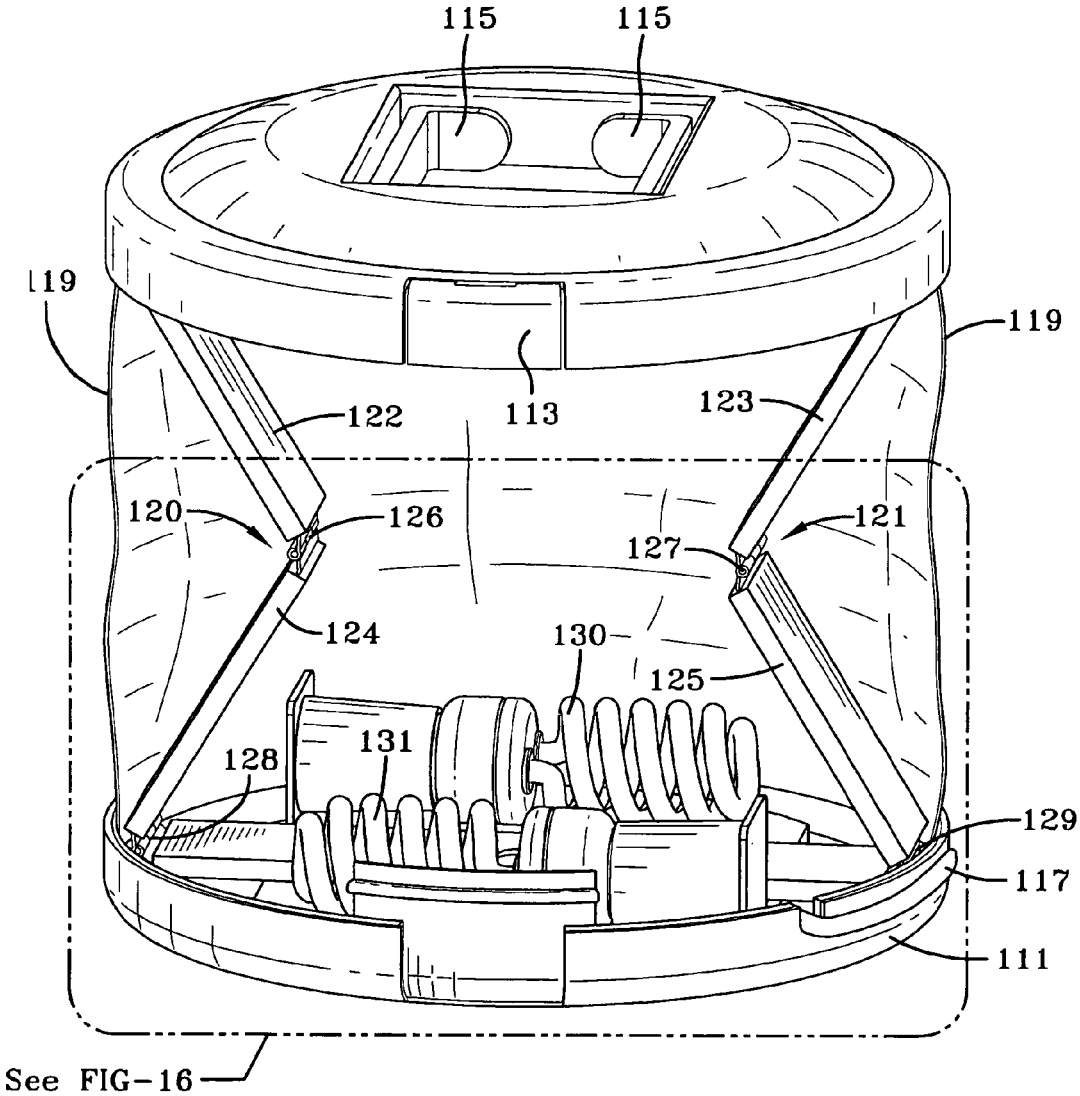
FIG. 14 is a side elevation view of a light device container, shown in an open position and with the diffuser material pulled away, in accordance with still another embodiment of the present invention.

FIG. 14 is a side elevation view of a light device container, shown in an open position and with the diffuser material 119 pulled away, in accordance with still another embodiment of the present invention. This view shows an example of the retractable support arrangement that may be used in accordance with the present invention, that being a pair of hinged supports 120 and 121 made of two or more members (typically wood, metal or plastic) that are hinged, such as members 122 and 124 connected by central hinge 126, and member 124 is linked to bottom portion 111 by bottom base hinge 128, and members 123 and 125 connected by central hinge 127, and member 125 is linked to bottom portion 111 by bottom base hinge 129. Top base hinges (not shown) corresponding to bottom base hinge 128 and 129 respectively also connect members 122 and 123 to top portion 110.

This Figure also shows the position of CFL bulbs 130 and 131 which may be attached to bottom portion 111 as shown.

Figure 15:
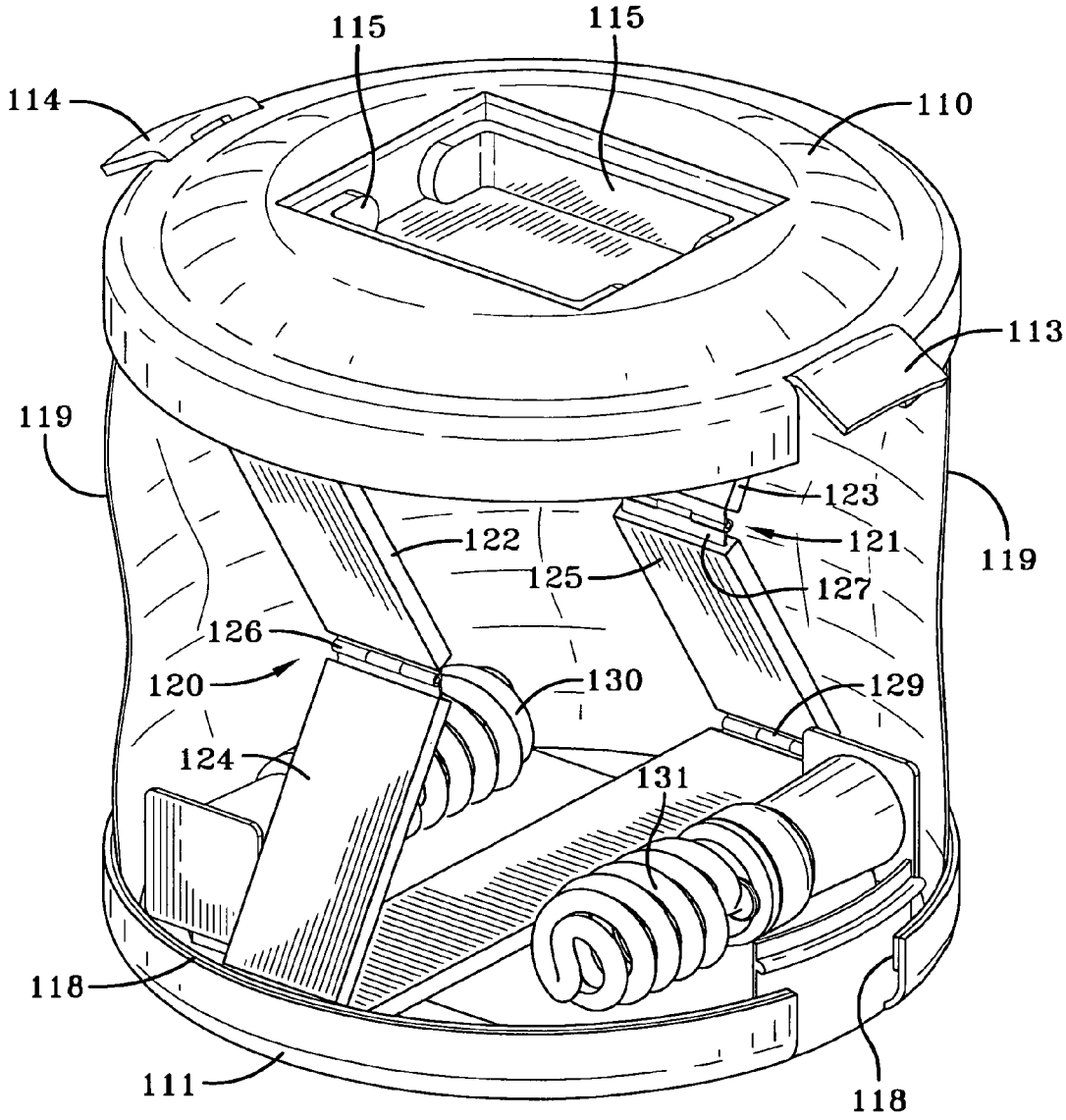
FIG. 15 is a side perspective view of a light device container, shown in an open position and with the diffuser material pulled away, in accordance with still another embodiment of the present invention.

FIG. 15 is a side perspective view of a light device container, shown in an open position and with the diffuser material 119 pulled away, in accordance with still another embodiment of the present invention. Reference numerals identical to those used in the earlier Figures are used in this Figure.

Figure 16:
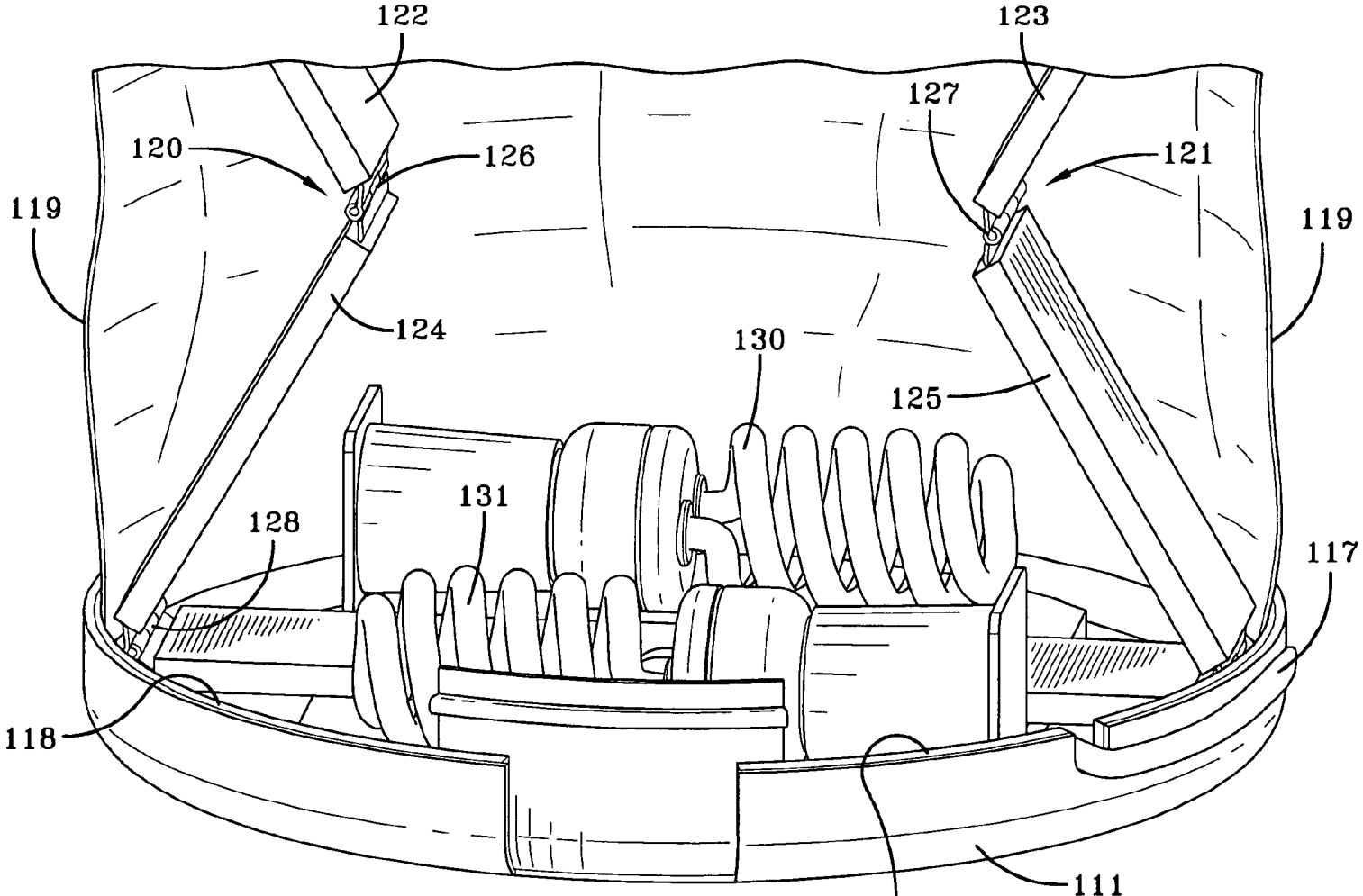
FIG. 16 is a detailed side perspective view of a light device container, shown in an open position and with the diffuser material pulled away, in accordance with still another embodiment of the present invention.

FIG. 16 is a detailed side perspective view of a light device container, shown in an open position and with the diffuser material 119 pulled away, in accordance with still another embodiment of the present invention. Reference numerals identical to those used in the earlier Figures are used in this Figure. This pair of hinged supports 120 and 121 preferably is provided with at least one sprung hinge to be able to urge the device into and maintain it in, the open position once the device clasps are opened.

This Figure shows the device in a partially closed position, such that the operation of the device may be better appreciated. This view shows the hinged support in a partially collapsed position.

Figure 17:
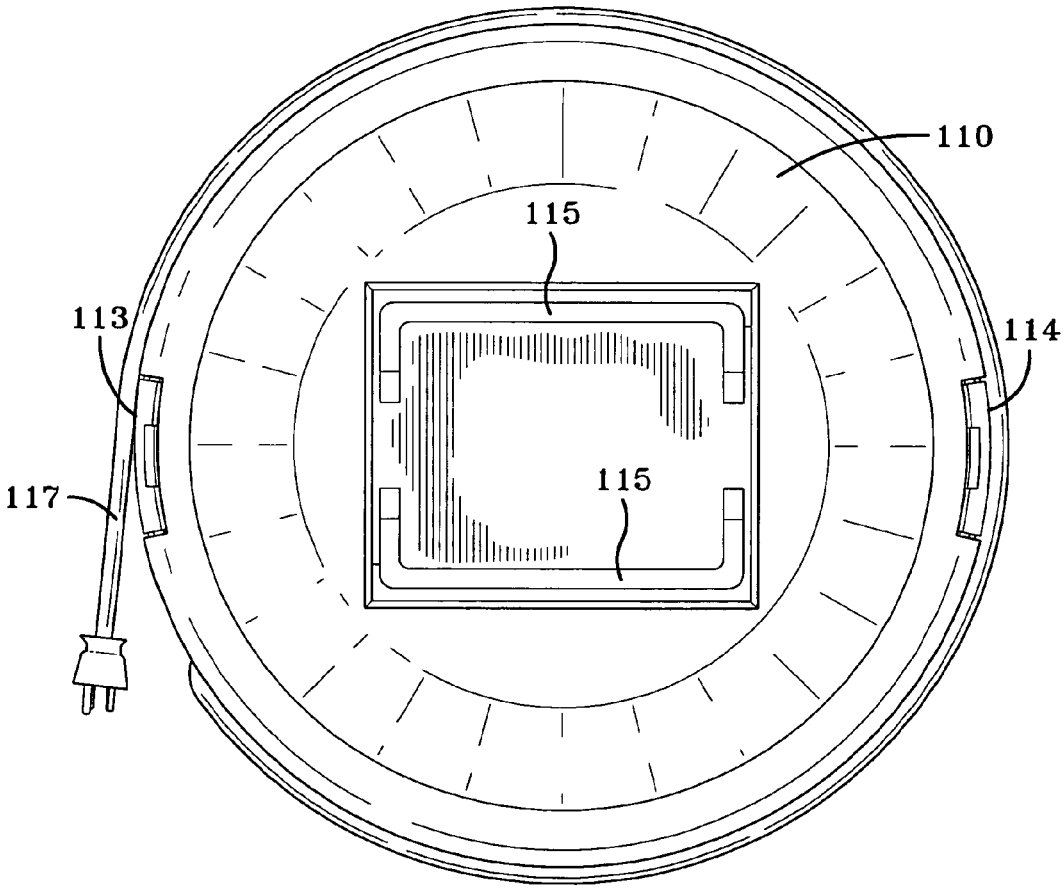
FIG. 17 is a top plan view of a light device container, shown in a closed position, in accordance with still another embodiment of the present invention.

FIG. 17 is a top plan view of a light device container, shown in a closed position, in accordance with still another embodiment of the present invention. Reference numerals identical to those used in the earlier Figures are used in this Figure.

This Figure shows the device in a partially closed position, such that the operation of the device may be better appreciated.

Figure 18:
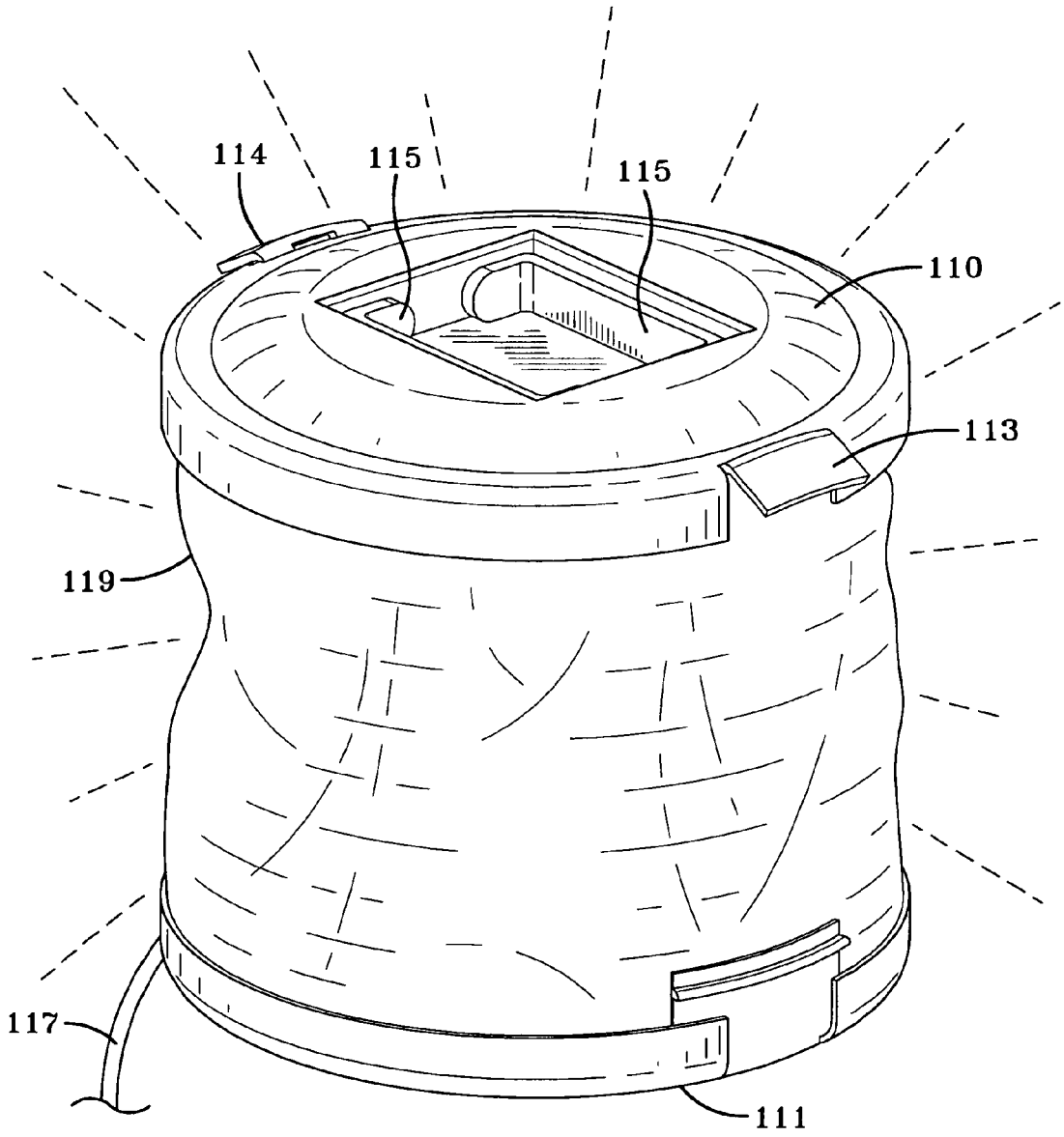
FIG. 18 is a side perspective view of a light device container, shown in an open position and illuminated, in accordance with still another embodiment of the present invention.

FIG. 18 is a side perspective view of a light device container, shown in an open position and illuminated, in accordance with still another embodiment of the present invention.

Figure 19:
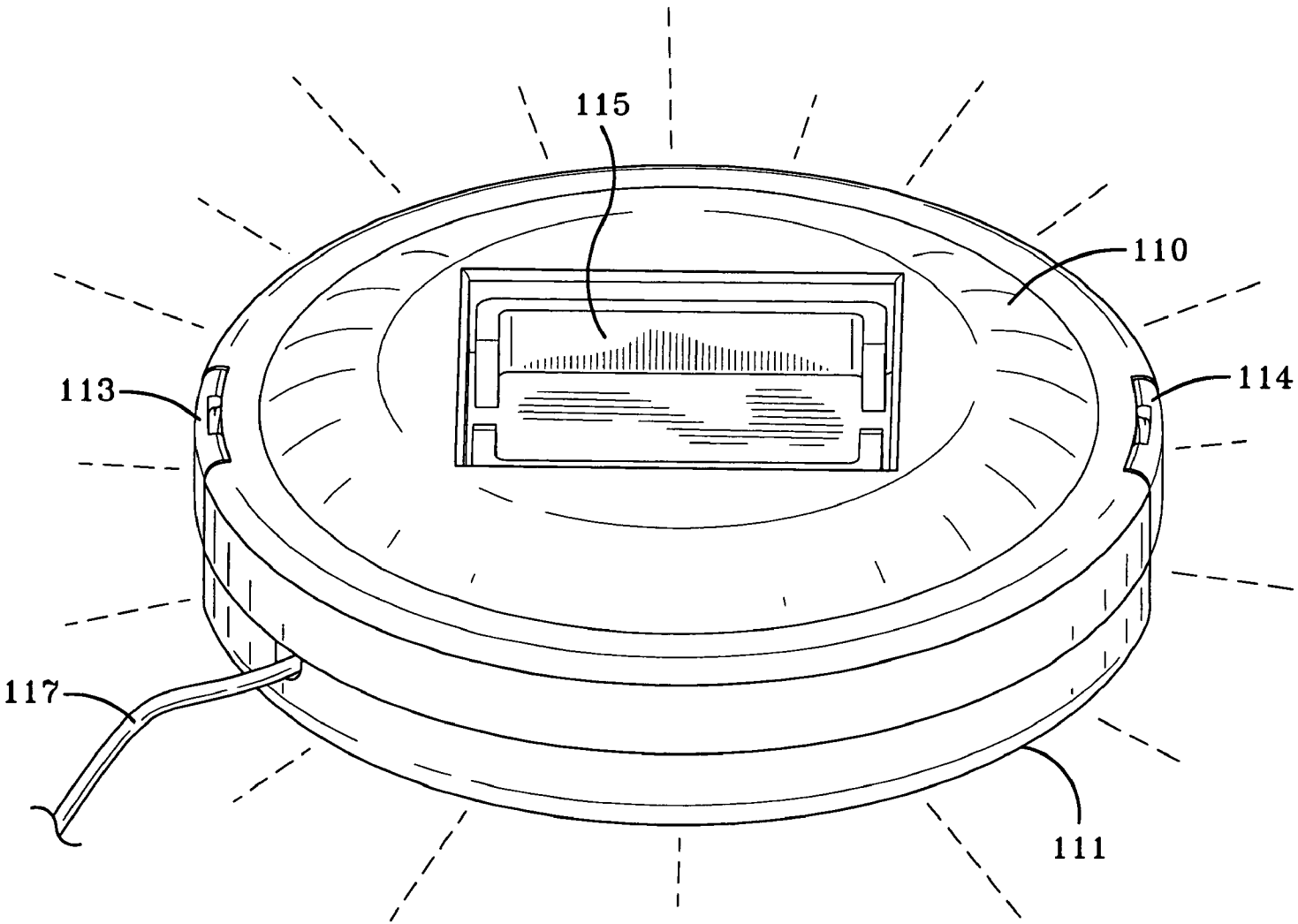
FIG. 19 is a top perspective view of a light device container, shown in a closed position and illuminated, in accordance with still another embodiment of the present invention.

FIG. 19 is a top perspective view of a light device container, shown in a closed position and illuminated, in accordance with still another embodiment of the present invention.

Figure 20:
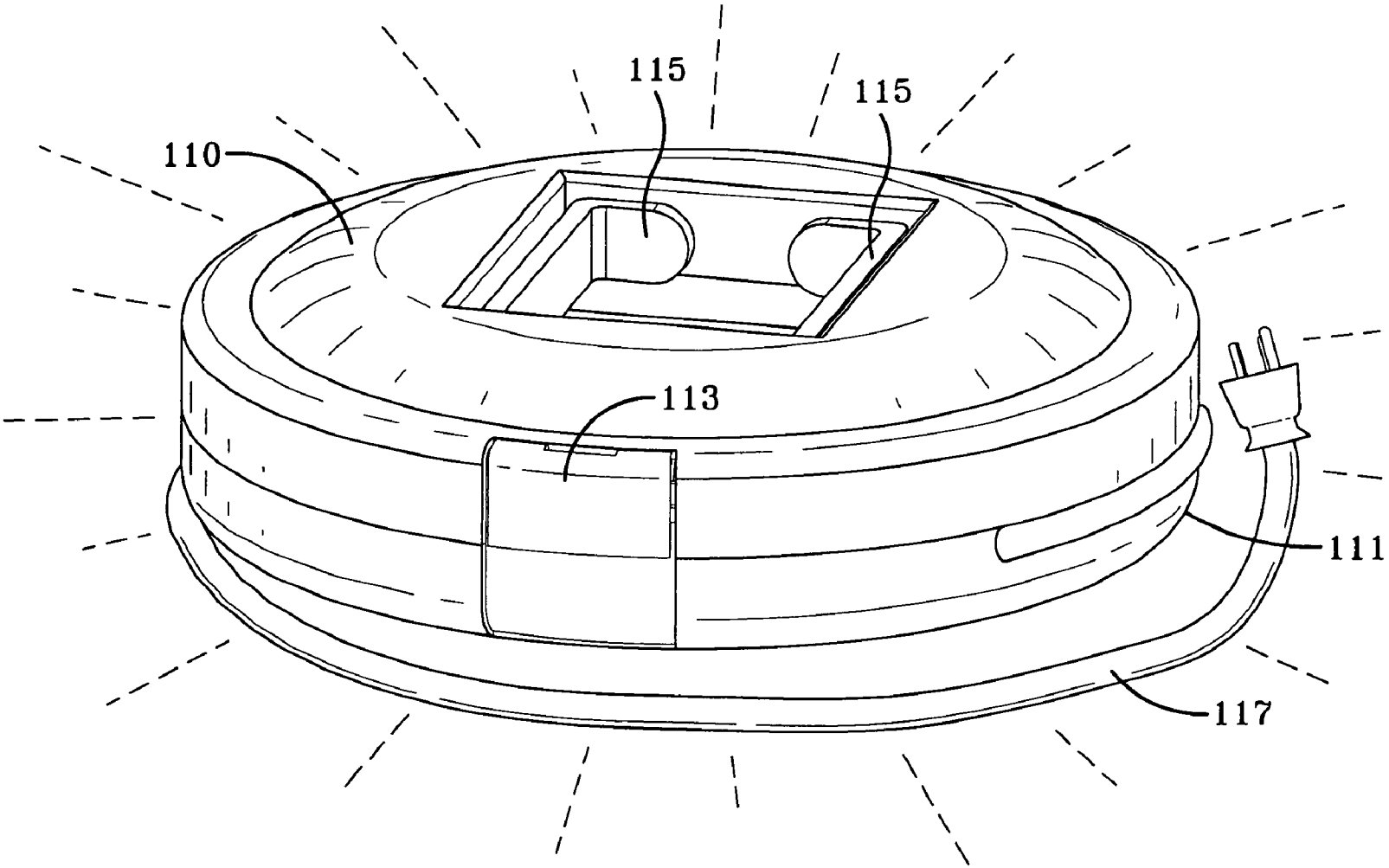
FIG. 20 is a side perspective view of a light device container, shown in a closed position and illuminated, in accordance with still another embodiment of the present invention.

FIG. 20 is a side perspective view of a light device container, shown in a closed position and illuminated, in accordance with still another embodiment of the present invention.

The outer container may also be provided with molded base portions to allow the container to be stood on edge for tight space applications. The outer container may also be provided with or incorporate hooks, clamps, eyelets or other structure or fixtures for hanging or mounting the device upon a pole or other supportive structure, such as those structure or fixtures known and used in the art for hanging such devices. This may also include the inclusion of a molded groove with a mounting screw or other interference fitting arrangement to hold the device onto a pole support. The device may also incorporate a collapsible tripod that may be incorporated into and/or hinged upon the device body.

The preferred embodiment may thus provide one or more of the flowing advantages: (1) 360 degree light output, (2) protection provided to the light diffuser material and lamps by virtue of the durable cover, (3) stability when in use, and ability to be used in low volume and short clearance areas, (4) reduction of glare, harsh shadow and light hot spots, (5) reduction and/or dissipation of heat produced by the lamp(s), and (6) ease of replacement of bulbs and diffuser material (such as through the use of a diffuser material releasably attached to the balance to the device).

Figure 21:
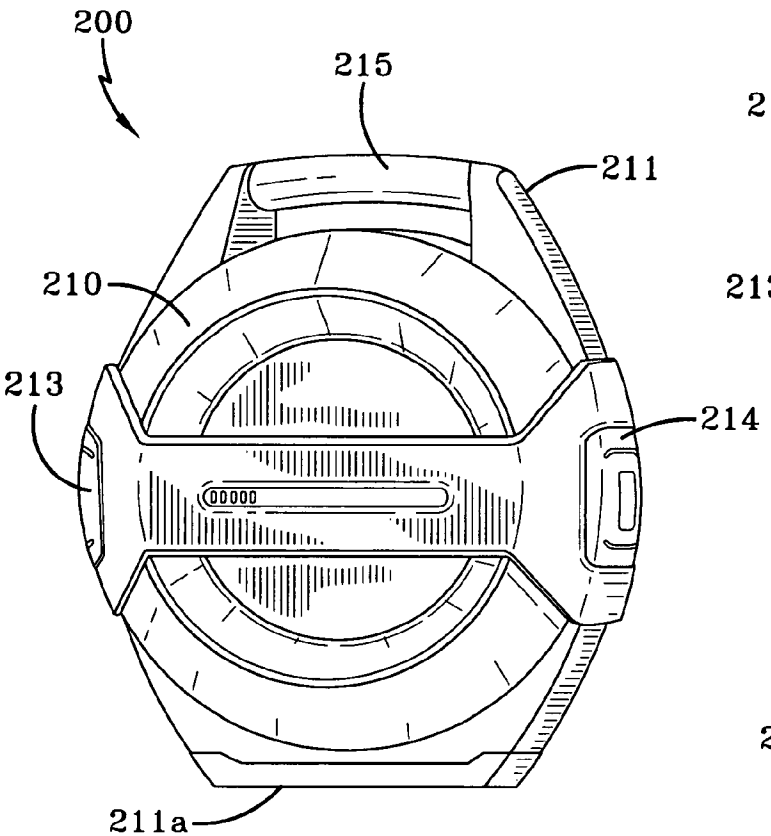
FIG. 21 is a side elevation view of a light device container, shown in a closed position, in accordance with still another embodiment of the present invention.

FIG. 21 is a figure showing a side elevation view of a light device container 200, shown in a closed position, in accordance with still another embodiment of the present invention. FIG. 21 shows top portion 210 and bottom portion 211. These portions may be held in the closed position by any appropriate closure means, such as clasp 213 and opposing clasp 214. Also shown in this Figure is optional handle 215. An electrical cord 217 adapted to supply electricity to the light source (typically from one to four light bulbs, preferably CFL bulbs). The bulbs may be placed in any configuration, but preferably will be arranged in such a way to provide light from the center of the device when in the open or closed position. Such arrangements may be nested arrangements or other arrangements whereby the light bulbs may move toward the center of the device upon opening, such as upon retractable supports or sprung supports or upon the support members as described herein. The cord 217 may be stored by winding it so that it may fit within the device (such as by pulling the cord 217 within the device through the aperture in bottom portion 211), or it may be wound around the device when in the closed position, such as upon capture fittings and the like (not shown), such as are known and used in the field of electric devices, such as those that may be attached to or molded into the outer surface of the top portion 210 and/or bottom portion 211. The bottom portion 211 may include a flat surface 211*a* to allow the device in the closed position to be stood on end. This allows the device to be illuminated while in the closed, upright position, with the optional use of a translucent plastic used for the container top portion 210 and/or bottom portion 211.

The top portion 210 may optionally be provided with retractable hook 218.

Figure 22:
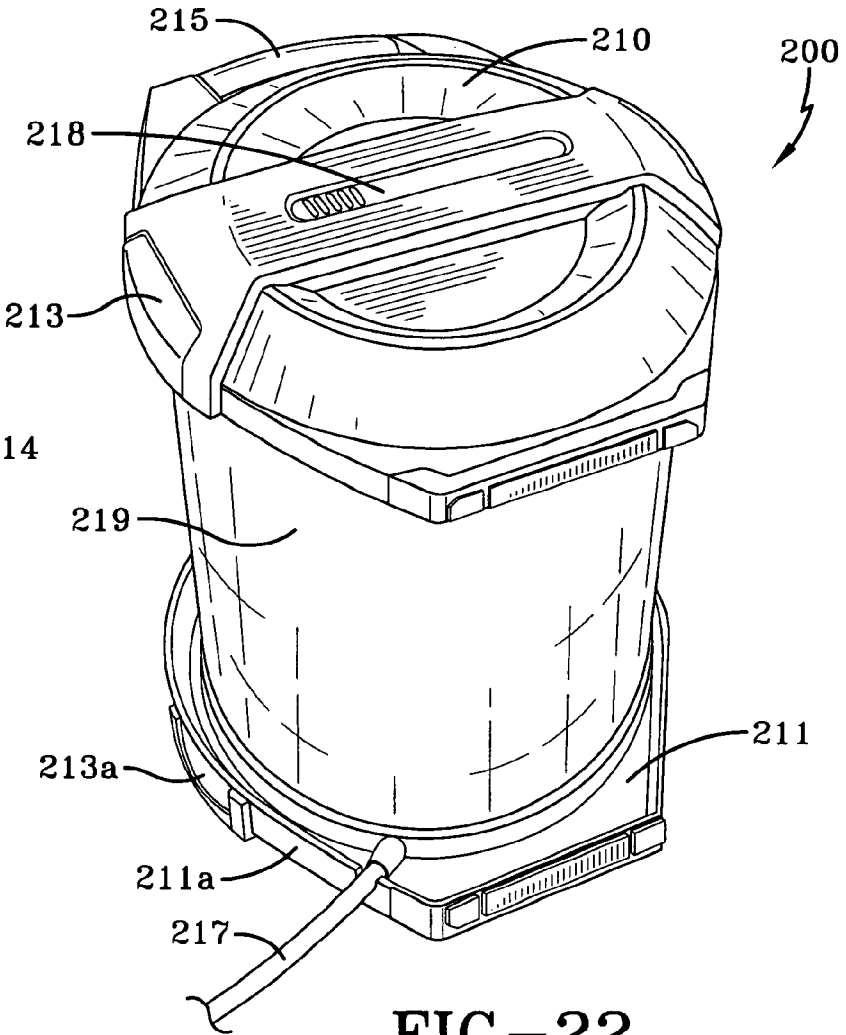
FIG. 22 is a side elevation view of a light device container, shown in an open position, in accordance with still another embodiment of the present invention.

FIG. 22 is a figure showing a side perspective view of a light device container 200, shown in an open position, in accordance with still another embodiment of the present invention. Reference numerals identical to those used in FIG. 21 are used in this Figure. This Figure also shows clasp 213 and opposing clasp 214 that engage corresponding portions of bottom portion 211 (such as portion 213*a*) and snap to maintain the device in the closed position.

This Figure shows diffuser material in the form of a cylindrical drape 219 that is attached, preferably removably attached, to the top portion 210 and bottom portion 211, preferably along the interior edge. This may be done by use of hook-and-loop strips, such as are shown in FIG. 13), and a corresponding strip, along the interior edge of the top portion 210 and bottom portion 211. Cylindrical drape 219 preferably is sized so as to be substantially taut in the open position, while able to be retracted and stored in the device upon closing. It is preferred that the diffuser material be a material that can withstand heat, and may be replaced if damaged or soiled. An example of such material may be rip-stop nylon (coated or uncoated with plastic), or similar materials such as woven fiberglass, linen or the like (which materials may be acceptable depending upon the desired application).

Figure 24:
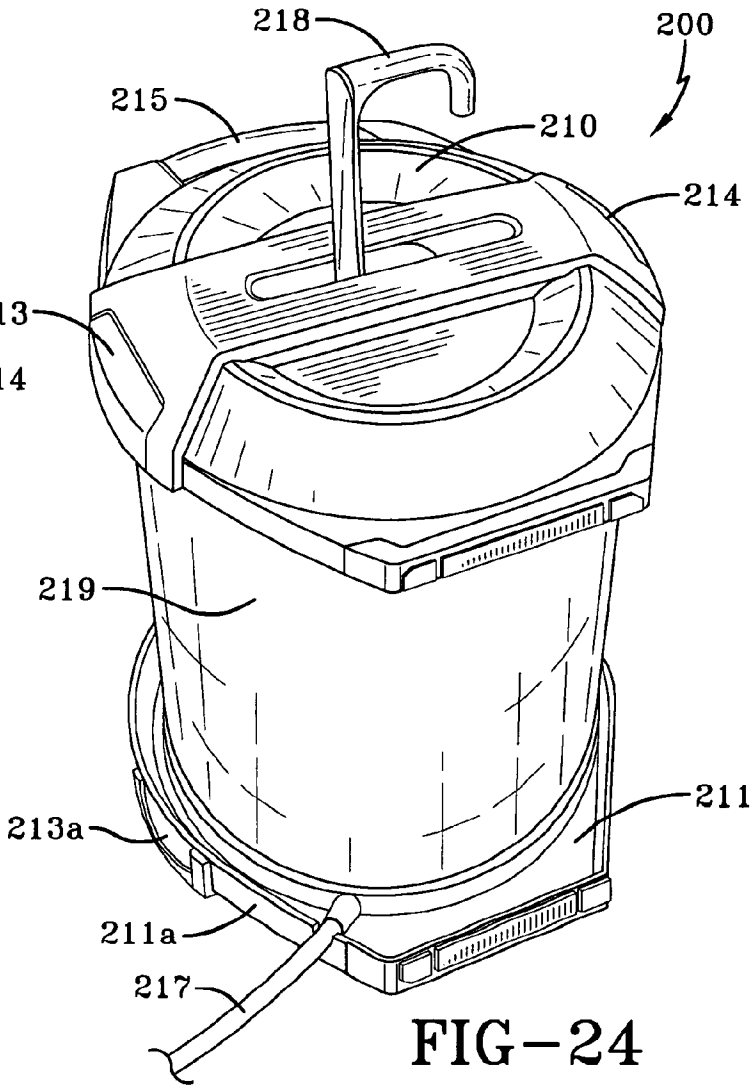
FIGS. 23 and 24 are Figures showing a progression of the opening of the light device container, shown respectively in a partially open position in FIG. 23 and a fully open position in FIG. 24, in accordance with still another embodiment of the present invention.
Figure 23:
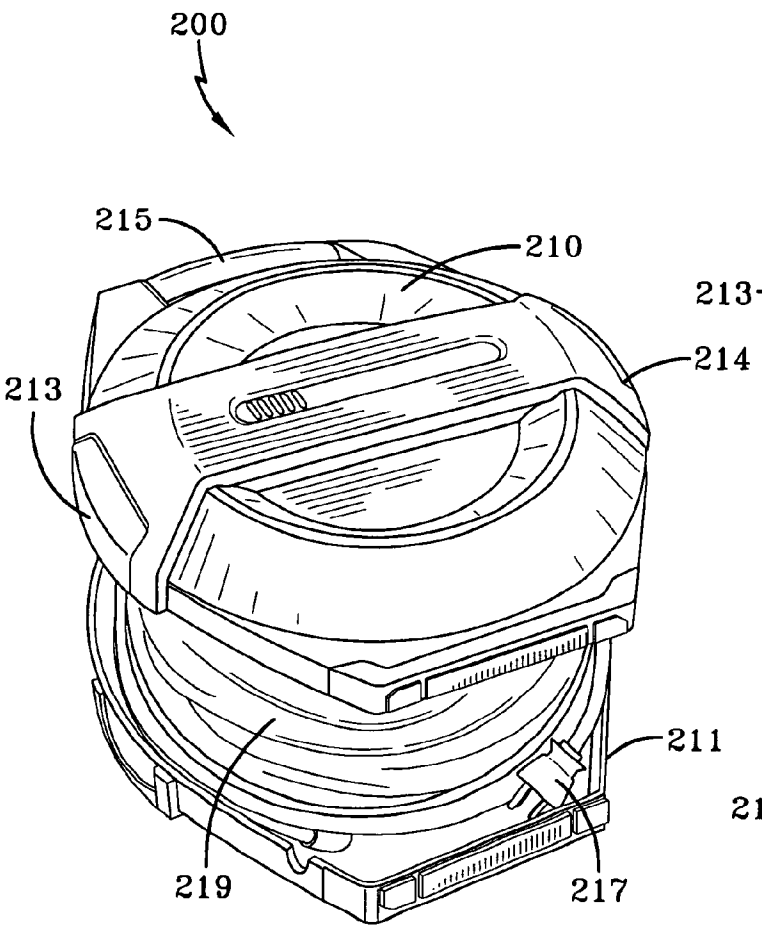

FIGS. 23 and 24 are Figures showing a progression of the opening of the light device container, shown respectively in a partially open position in FIG. 23 and a fully open position in FIG. 24, in accordance with still another embodiment of the present invention. Reference numerals identical to those used in the earlier Figures are used in this Figure. FIG. 23 shows the storage of the cord 217 within the device and ready for closure. FIG. 24 shows the device in the open position and with retractable hook 218 in the extended position, placed there by rotating the hook 218 as shown.

Figure 25:
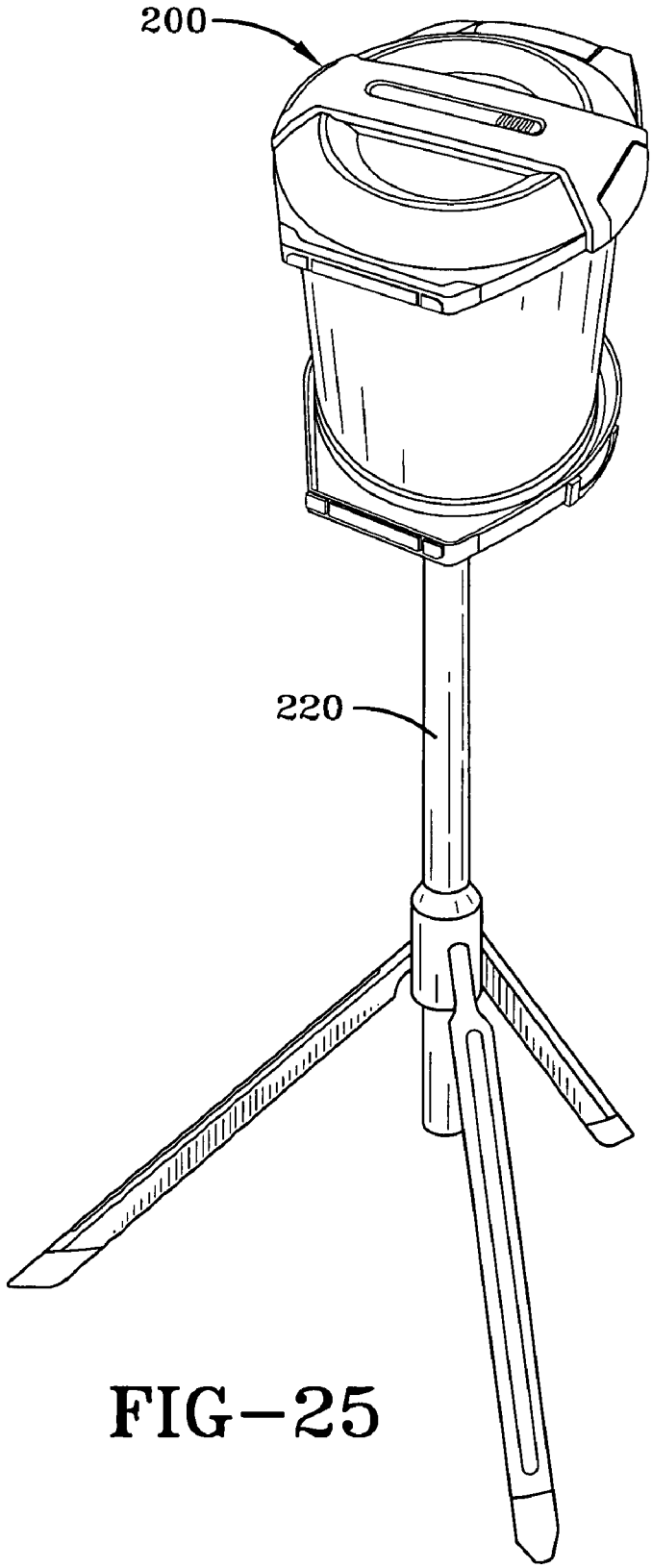
FIG. 25 is a figure showing a side perspective view of a light device container, shown in an open position, in accordance with still another embodiment of the present invention.

FIG. 25 is a figure showing a side perspective view of a light device container, shown in an open position, in accordance with still another embodiment of the present invention. Reference numerals identical to those used in FIG. 21 are used in this Figure. This Figure shows light device container in an open position and mounted on tripod 220 or other elevating support. This may be a permanent or releasable attachment such as by using an interference fit of the pole into a detent molded into the bottom portion 211. Alternative attachments may be selected from the use of permanent or releasable fixtures known and used in the art for attaching poles and the like to flat surfaces.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claims, including the full range of equivalency to which each element thereof is entitled.

What is claimed is:

1. A collapsible lighting device comprising:

a. a container having a base portion and a lid portion, said portions adapted to contain an initial volume and adapted to be reversibly moved from a closed position to an open position;

b. at least one light source disposed in said container; and c. a collapsible envelope of a diffuser material disposed in said container, and adapted to be reversibly moved from a contained position defining a contained volume within said container when said container is in said closed position, to a deployed position wherein said collapsible envelope of a diffuser material defines a volume greater than said contained volume and extending outside said container, when said container is in said open position.

2. A lighting device according to claim 1, additionally comprising a frame adapted to be reversibly moved from a closed position to an open position, and to maintain said collapsible envelope of a diffuser material in said deployed position when said container is in said open position, said frame adapted to be collapsed into said container when said container is in said closed position.

3. A lighting device according to claim 2, wherein said frame comprises a plurality of hinged panels attached to said container so as to be adapted to be collapsed into said container when said container is in said closed position.

4. A lighting device according to claim 1 wherein said collapsible envelope of a diffuser material in said deployed position has a cylindrical shape around said at least one light source.

5. A lighting device according to claim 1, wherein said base and lid portions comprise a translucent plastic material.

6. A lighting device according to claim 1 wherein said container is adapted to be attached to a pole.

7. A lighting device according to claim 1 wherein said container additionally comprises a hook.

8. A lighting device according to claim 1 wherein said lid portion additionally comprises a handle.

9. A lighting device according to claim 1 wherein said base portion additionally comprises a retractable base extension.

10. A lighting device according to claim 1 wherein said diffuser material is releasably attached to said container.

11. A collapsible lighting device comprising:

a. a container having a base portion and a lid portion, wherein said base and lid portions are of a translucent plastic material and are adapted to contain a space when closed upon one another;

b. at least one light source disposed in said container; and c. a collapsible envelope of a diffuser material disposed in said base portion, and adapted to be reversibly moved from a contained position within said space contained by said base and lid portions, to a deployed position upon opening said lid portion.

12. A collapsible lighting device comprising:

a. a container having a base portion and a lid portion, each said portion having a concave disk shape and adapted to contain an initial volume and adapted to be reversibly moved from a closed position to an open position;

b. at least one light source disposed in said container; and c. a collapsible envelope of a diffuser material disposed in said container, and adapted to be reversibly moved from a contained position defining a contained volume within said container when said container is in said closed position, to a deployed position wherein said collapsible envelope of a diffuser material defines a volume greater than said contained volume and extending outside said container, when said container is in said open position, said collapsible envelope of a diffuser material having a substantially cylindrical shape.

13. A lighting device according to claim 12 wherein said collapsible envelope of a diffuser material in said deployed position has a cylindrical shape around said at least one light source.

14. A lighting device according to claim 12, additionally comprising at least one hinged support adapted to be reversibly moved from a closed position to an open position, and to maintain said collapsible envelope of a diffuser material in said deployed position when said container is in said open position, said hinged support adapted to be collapsed into said container when said container is in said closed position.

15. A lighting device according to claim 12, wherein said base and lid portions comprise a translucent plastic material.

16. A lighting device according to claim 12, wherein said at least one hinged support is attached to said portions, so as to be adapted to be collapsed into said container when said container is in said closed position.

17. A lighting device according to claim 12, additionally comprising at least one hinged support adapted to be reversibly moved from a closed position to an open position, and to maintain said collapsible envelope of a diffuser material in said deployed position when said container is in said open position, said hinged support adapted to be collapsed into said container when said container is in said closed position, and wherein said at least one light source comprises a light bulb mounted on said hinged support.

18. A lighting device according to claim 12 wherein said container is adapted to be attached to a pole.

19. A lighting device according to claim 12 wherein said container additionally comprises a hook.

20. A lighting device according to claim 12 wherein said lid portion additionally comprises a handle.

21. A lighting device according to claim 12 wherein said base portion additionally comprises a retractable base extension.

22. A lighting device according to claim 12 wherein said diffuser material is releasably attached to said container.

* * * * *